US011512510B2

(12) United States Patent
Ottino

(10) Patent No.: US 11,512,510 B2
(45) Date of Patent: Nov. 29, 2022

(54) CLOSURE LATCH ASSEMBLY FOR VEHICLE DOOR PANELS HAVING A LATCH MECHANISM WITH ENHANCED PAWL CONFIGURATION

(71) Applicant: MAGNA CLOSURES INC., Newmarket (CA)

(72) Inventor: Franco Giovanni Ottino, San Giuliano Terme (IT)

(73) Assignee: MAGNA CLOSURES INC., Newmarket (CA)

( * ) Notice: Subject to any disclaimer, the term of this patent is extended or adjusted under 35 U.S.C. 154(b) by 324 days.

(21) Appl. No.: 16/590,937

(22) Filed: Oct. 2, 2019

(65) Prior Publication Data

US 2020/0109579 A1 Apr. 9, 2020

Related U.S. Application Data

(60) Provisional application No. 62/740,565, filed on Oct. 3, 2018.

(51) Int. Cl.
*E05B 85/26* (2014.01)
*E05B 79/22* (2014.01)
(Continued)

(52) U.S. Cl.
CPC ..... *E05B 85/26* (2013.01); *E05B 15/0205* (2013.01); *E05B 77/04* (2013.01);
(Continued)

(58) Field of Classification Search
CPC ..... E05B 77/02; E05B 77/04; E05B 77/06; E05B 81/14; E05B 85/20; E05B 85/24;
(Continued)

(56) References Cited

U.S. PATENT DOCUMENTS 5,092,639 A * 3/1992 Di Giusto ..... E05B 85/26 292/210
5,188,406 A * 2/1993 Sterzenbach ..... E05B 85/26 292/210
(Continued)

FOREIGN PATENT DOCUMENTS

FR 2930581 A1 * 10/2009 ..... E05B 85/26
WO WO-2011023182 A2 * 3/2011 ..... E05B 77/04

*Primary Examiner* — Kristina R Fulton
*Assistant Examiner* — Noah Horowitz
(74) *Attorney, Agent, or Firm* — Dickinson Wright PLLC

(57) ABSTRACT

A closure latch assembly for a motor vehicle closure panel includes a housing; a ratchet pivotably mounted for movement between striker capture and a striker release positions; a release lever, and a pawl assembly. Pawl assembly includes a first and second pawls. First pawl is pivotably mounted to housing for movement about a first pivot axis between ratchet checking and ratchet releasing positions in response to movement of release lever. Second pawl is pivotably mounted to first pawl for movement about a second pivot axis spaced from first pivot axis. Second pawl is engaged with ratchet locking surface while first pawl is in the ratchet checking position to releasably maintain ratchet in the striker capture position. Second pawl is pivotal relative to first pawl about second pivot axis when first pawl pivots toward the ratchet releasing position to allow ratchet to pivot to the striker release position.

24 Claims, 20 Drawing Sheets

(51) Int. Cl.

| | |
|---|---|
| ***E05B 83/36*** | (2014.01) |
| ***E05B 15/02*** | (2006.01) |
| ***E05B 81/16*** | (2014.01) |
| ***E05B 77/04*** | (2014.01) |
| *E05B 15/00* | (2006.01) |

(52) U.S. Cl.
CPC ..... *E05B 79/22* (2013.01); *E05B 81/16* (2013.01); *E05B 83/36* (2013.01); *E05B 15/0046* (2013.01)

(58) Field of Classification Search
CPC .. E05B 85/243; E05B 85/26; Y10T 292/1047; Y10T 292/1078; Y10T 292/1082; Y10S 292/22; Y10S 292/23; Y10S 292/65
See application file for complete search history.

(56) References Cited

U.S. PATENT DOCUMENTS

| | | | | |
|---|---|---|---|---|
| 6,581,988 | B1 | 6/2003 | Mihail | |
| 7,926,858 | B2 * | 4/2011 | Otsuka | B60N 2/01583 292/216 |
| 2012/0313384 | A1 * | 12/2012 | Gumbo | E05B 81/70 292/199 |
| 2013/0285390 | A1 | 10/2013 | Jankowski et al. | |
| 2016/0215536 | A1 | 7/2016 | Cumbo et al. | |
| 2016/0290021 | A1 * | 10/2016 | Nishio | E05B 85/20 |
| 2019/0024424 | A1 | 1/2019 | Brickner | |
| 2019/0264474 | A1 | 8/2019 | Ottino et al. | |

* cited by examiner

CLOSURE LATCH ASSEMBLY FOR VEHICLE DOOR PANELS HAVING A LATCH MECHANISM WITH ENHANCED PAWL CONFIGURATION

CROSS-REFERENCE TO RELATED APPLICATION

This application claims the benefit of U.S. Provisional Application Ser. No. 62/740,565, filed Oct. 3, 2018, which is incorporated herein by way of reference in its entirety.

FIELD

The present disclosure relates generally to closure latch assemblies for use in motor vehicle closure systems. More specifically, the present disclosure is directed to a closure latch assembly having a two-component pawl assembly.

BACKGROUND

This section provides background information related to the present disclosure which is not necessarily prior art.

A vehicle closure panel, such as a door for a vehicle passenger compartment, is commonly hinged to swing between open and closed positions and includes a closure latch assembly mounted within the door. The closure latch assembly functions in a well-known manner to latch the door when it is closed and lock the door in its closed position, and to unlatch the door to permit subsequent movement of the door to its open position. As is also well known, the closure latch assembly is configured to include a latch mechanism for latching the door, a lock mechanism interacting with the latch mechanism for locking the door, and a latch release mechanism interacting with the lock mechanism and the latch mechanism for unlocking/unlatching the door. These mechanisms can be manually operated and/or power-operated to provide the desired level of standard features.

The latch mechanism typically includes a pawl that engages a ratchet to releasably maintain the ratchet in a striker capture position, wherein the pawl is pivotal to slide along a surface of the ratchet to allow the ratchet to snap suddenly to a striker release position. The sliding movement of the pawl along the ratchet is initiated by overcoming static friction, and results in sliding friction thereafter, which in turn, causes wear and increases effort required to actuate the latch mechanism. Additionally, upon the pawl sliding to a position whereat the ratchet is released, a sudden popping noise is typically generated from the ratchet snapping suddenly to the striker release position. Further yet, in a crash condition, movement of the pawl from an impact force may result in release of the ratchet to the striker release position.

In view of the above, there remains a desire to develop alternative closure panel latch assemblies which address and overcome limitations associated with known closure panel latch assemblies.

Accordingly, while commercially-available closure latch assemblies are satisfactory to meet all operational and regulatory requirements, a recognized need exists to advance the technology and provide optimized closure latch assemblies having enhanced functionality over an extended useful life, while minimizing the effort required for intended actuation thereof, reducing noise generated by latch assemblies during actuation thereof, enhancing performance during a crash condition, that are reliable and easy-to-use, that are cost efficient in manufacture and assembly, and that minimize package size and weight.

SUMMARY

This section provides a general summary of the disclosure and is not intended to be interpreted as a comprehensive and exhaustive listing of its full scope or all of its aspects, features and structured configurations.

It is an aspect of the present disclosure to provide a closure latch assembly for a vehicle closure panel that addresses at least those issues discussed above.

It is a related aspect of the present disclosure to provide a closure latch assembly having a pawl assembly that releases a ratchet with substantially no sliding friction, thereby providing for minimal release effort and reliable and repeatable selective (intended, whether manually or via motor driven assistance) actuation of the closure latch assembly.

In a related aspect, the pawl assembly can release the ratchet for movement of the ratchet from a striker capture position to a striker release position via substantially pure rolling motion between the pawl assembly and the ratchet, thereby resulting in a smooth transition of the ratchet from the striker capture position to a striker release position, and thus, resulting a quiet operation of closure latch assembly.

In a related aspect, a bias can be imparted by the ratchet on the pawl assembly to cause the rolling motion between the pawl assembly and the ratchet that automatically releases the ratchet for movement from the striker capture position to the striker release position.

In a related aspect, the pawl assembly is provided as a two-component assembly having a first pawl configured for operable communication with a latch release lever and a second pawl pivotably coupled to the first pawl for engagement with the ratchet, wherein the first pawl can be configured to remain free from contact with the ratchet during normal operation of the closure latch assembly, thus enhancing smooth, quiet, reduced effort actuation of closure latch assembly.

In accordance with these and other aspects, a closure latch assembly for a motor vehicle closure panel is provided. The closure latch assembly includes a housing; a ratchet pivotably mounted to the housing for pivoting movement between a striker capture position and a striker release position, with the ratchet having a ratchet locking surface; a release lever pivotably mounted to the housing; and a pawl assembly. The pawl assembly includes a first pawl and a second pawl. The first pawl is pivotably mounted to the housing for pivoting movement about a first pivot axis between a ratchet checking position and a ratchet releasing position in response to pivotal movement of the release lever. The second pawl is pivotably mounted to the first pawl for pivoting movement about a second pivot axis spaced from the first pivot axis. The second pawl is engaged with the ratchet locking surface of the ratchet while the first pawl is in the ratchet checking position to releasably maintain the ratchet in the striker capture position. The second pawl is pivotal relative to the first pawl about the second pivot axis when the first pawl pivots toward the ratchet releasing position to allow the ratchet to pivot to the striker release position.

In accordance with another aspect, first pawl extends from the second pivot axis along opposite sides to a free end of the first pawl and the second pawl extends from the second pivot axis along opposite sides to a free end of the second pawl, wherein the distance from the second pivot axis to the free end of the second pawl is greater than the distance extending from the second pivot axis to the free end of the first pawl.

In accordance with another aspect, the free end of the first pawl can be spaced from the ratchet locking surface while the first pawl is in the ratchet checking position, thereby resulting in no friction therebetween.

In accordance with another aspect, the free end of the first pawl can extend in oblique relation relative to the opposite sides of the first pawl to facilitate the prevention of an inadvertent release of the ratchet from the pawl assembly during a crash condition, thereby maintaining the ratchet in its striker capture position.

In accordance with another aspect, the free end of the second pawl rolls on the ratchet locking surface as the ratchet pivots from the striker capture position toward the striker release position, thereby resulting in no or substantially no (negligible) sliding friction between the second pawl and the ratchet.

In accordance with another aspect, a ratchet spring that imparts a bias on the ratchet to move from the striker capture position to the striker release position causes the ratchet to impart a force on the second pawl to automatically cause the second pawl to pivot relative to the first pawl about the second pivot axis when the first pawl pivots toward the ratchet releasing position.

In accordance with another aspect, the force imparted by the ratchet on the second pawl can extend along a direction passing through the first pivot axis and the second pivot axis when the first pawl is in the ratchet checking position, thereby assuring the pawl assembly remains in the ratchet checking position, until desired otherwise.

In accordance with another aspect, the force imparted by the ratchet on the second pawl can extend along a direction passing through the first pivot axis, but not the second pivot axis, when the first pawl is in the ratchet releasing position, thereby imparting a torque on the second pawl relative to the second pivot axis and causing the second pawl to automatically pivot, as desired, about the second pivot axis to allow the ratchet to move freely to the striker release position.

In accordance with another aspect, the second pivot axis is located between the first pivot axis and the free end of the first pawl, thereby promoting the rotation of the second pawl about the second pivot axis, when desired.

In accordance with another aspect, the first pawl is provided with a pawl arm extending from the first pivot axis to the free end and can be provided having a pawl lug segment extending from the first pivot axis for operable engagement with the release lever, wherein the first pivot axis is located between the pawl arm and the pawl lug segment, thereby promoting the rotation of the first pawl about the first pivot axis via selective actuation of the release lever.

In accordance with another aspect, free end of the second pawl is configured to collapse under an impact force of the ratchet locking surface to bring the ratchet locking surface into engagement with the free end of the first pawl in a crash condition to prevent the ratchet from moving out of the striker capture position, unless intended otherwise.

In accordance with another aspect, a method of preventing inadvertent release of a ratchet of a closure latch assembly from a striker capture position during a crash condition is provided. The method includes providing a pawl assembly having a first pawl and a separate second pawl, with the first pawl being pivotably mounted to a housing for pivoting movement about a first pivot axis between a ratchet checking position and a ratchet releasing position and the second pawl being pivotably mounted to the first pawl for pivoting movement about a second pivot axis spaced from the first pivot axis. Further, configuring the second pawl being engaged with a ratchet locking surface of the ratchet while the first pawl is in the ratchet checking position to releasably maintain the ratchet in the striker capture position. Further, configuring the second pawl being pivotal relative to the first pawl about the second pivot axis when the first pawl pivots toward the ratchet releasing position to allow the ratchet to pivot to the striker release position. Further yet, configuring a free end of the second pawl to collapse under an impact force of the ratchet locking surface during the crash condition to bring the ratchet locking surface into engagement with the free end of the first pawl, thereby preventing inadvertent movement of the ratchet to the striker release position.

In accordance with another aspect, the method further includes configuring the second pawl to be pivoted during normal use about the second pivot axis via a forced applied by a biasing member of the ratchet upon pivoting the first pawl to the ratchet releasing position.

In accordance with another aspect, the method further includes configuring the second pawl to pivot about the second pivot axis during normal use under the bias of the ratchet biasing member without generating sliding friction between the second pawl and the ratchet, thereby enhancing the ease of the release effort and reliability with which the closure latch assembly can be selectively actuated.

In accordance with another aspect, there is provided a method of releasing of a ratchet of a closure latch assembly from a striker capture position, including the steps of: providing a pawl assembly having a first pawl pivotably mounted to a housing for pivoting movement about a first pivot axis between a ratchet checking position and a ratchet releasing position and having a second pawl pivotably mounted to the first pawl for pivoting movement about a second pivot axis spaced from the first pivot axis, the second pawl being engaged with a ratchet locking surface of the ratchet while the first pawl is in the ratchet checking position to releasably maintain the ratchet in the striker capture position and the second pawl being pivotal relative to the first pawl about the second pivot axis; and imparting a pivoting movement of the first pawl toward the ratchet releasing position to cause the second pawl to pivot relative to the first pawl about the second pivot axis to allow the ratchet to pivot to the striker release position.

In accordance with a further aspect, the method can further include the step of configuring the second pawl to disengage from the ratchet during pivoting movement of the second pawl pivot axis without a sliding interaction between the ratchet and the second pawl.

In accordance with a further aspect, the method can further includes the step configuring the second pawl to disengage from the ratchet during pivoting movement of the second pawl pivot axis without, or substantially without, a sliding interaction between the ratchet and the second pawl.

In accordance with another aspect, there is provided a method of preventing inadvertent release of a ratchet of a closure latch assembly from a striker capture position during a crash condition, including the steps of providing a pawl assembly pivotably mounted in a housing for pivoting movement about a first pivot axis between a ratchet checking position and a ratchet releasing position and having a free end being engaged with a ratchet locking surface of the ratchet while the pawl assembly is in the ratchet checking position to releasably maintain the ratchet in the striker capture position, and configuring the pawl assembly to deform in response to a crash force imparted by the ratchet on the pawl assembly to allow for a variation in an angle of force applied by the ratchet on the pawl assembly. In accordance with a related aspect, the variation in the angle of force applied by the ratchet on the pawl assembly locks the pawl assembly in the ratchet checking position. In accordance with a related aspect, the variation in the angle of force applied by the ratchet on the pawl assembly applies a closing torque on the pawl assembly urging the pawl assembly towards the ratchet checking position.

In accordance with another aspect, there is provided a closure latch assembly for a motor vehicle closure panel, including a housing, a ratchet pivotably mounted in the housing for pivoting movement between a first striker capture position, a second striker capture position and a striker release position, the ratchet having a ratchet locking surface, and a pawl assembly pivotally mounted in the housing for pivoting movement about a pivot axis between a ratchet checking position and ratchet releasing position and including a free end being engaged with the ratchet locking surface while the pawl assembly is in the ratchet checking position to releasably maintain the ratchet in one of the first striker capture position and the second striker capture position and a further including a deformable portion allowing the ratchet to pivot from the first striker capture position to the second striker capture position in response to the ratchet pivoting during a crash event and deforming the deformable portion.

In accordance with another related aspect, there is provided a closure latch assembly for a motor vehicle closure panel, including a housing, a ratchet pivotably mounted in the housing for pivoting movement between a striker capture position and a striker release position, the ratchet having a ratchet locking surface, and a pawl assembly pivotally mounted in the housing for pivoting movement about a pivot axis between a ratchet checking position and ratchet releasing position and having a free end being engaged with the ratchet locking surface when the pawl assembly is in the ratchet checking position to releasably maintain the ratchet in the striker capture position, the pawl assembly being formed from a metal sheet, wherein the free end is defined by an uncut portion of the metal sheet.

BRIEF DESCRIPTION OF THE DRAWINGS

These and other aspects, features, and advantages of the present disclosure will be readily appreciated, as the same becomes better understood by reference to the following detailed description when considered in connection with the accompanying drawings wherein.

Corresponding reference numerals are used throughout all of the drawings to identity common components.

DETAILED DESCRIPTION OF EXAMPLE EMBODIMENTS

Figure 1:
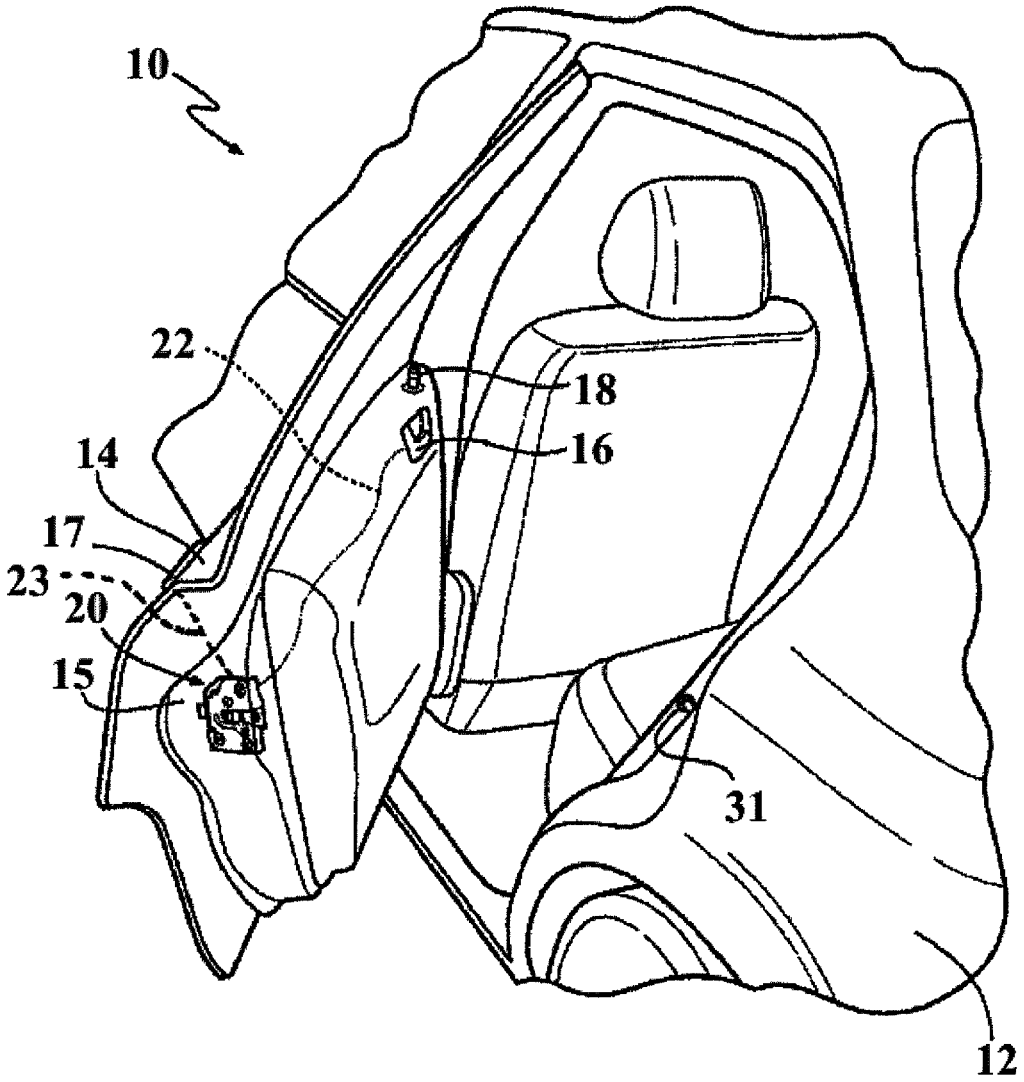
FIG. 1 is a partial perspective view of a motor vehicle equipped with a door having a closure latch assembly constructed in accordance with and embodying the teachings of the present disclosure.

In general, an example embodiment(s) of a latch assembly constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

FIG. 1 is a partial isometric view of a motor vehicle 10 having a vehicle body 12 and at least one closure member, shown as vehicle passenger door 14, by way of example and without limitation. Vehicle door 14 is hinged to vehicle body 12 for movement between closed and open positions. Vehicle door 14 includes an inside door handle 16, an outside door handle 17, a lock knob 18, and a closure latch assembly 20 positioned on an edge face 15 of vehicle door 14. As will be detailed, closure latch assembly 20 includes a latch mechanism 40 configured to releasably latch a striker 31 fixed to vehicle body 12, a latch release mechanism 91 (FIG. 4) configured to selectively release the latch mechanism 40, a lock mechanism (not shown) configured to selectively lock the latch mechanism 40, an inside handle-actuated release mechanism 22 configured to connect inside door handle 16 to the latch release mechanism, and an outside handle-actuated release mechanism 23 configured to connect outside door handle 17 to the latch release mechanism. However, it should be understood that the particular construction of these specific mechanisms not shown is not critical or limiting to the present disclosure which relates to integration of a two-component pawl assembly, referred to hereafter as pawl assembly 46, of latch mechanism 40. As will be detailed hereafter, the pawl assembly 46 is configured to provide enhanced, reliable and repeatable, low effort actuation (minimal intended force needed to selectively actuate closure latch assembly 20), while also minimizing noise generation during actuation, being economical in manufacture, having a small overall package size and exhibiting a long and useful life.

While the closure member is illustrated as a passenger door 14, it is to be understood that closure latch assembly 20 described and illustrated herein can likewise be adapted for use with alternative closure members such as, by way of example and without limitation, liftgates, tailgates, hatch doors, sliding doors, trunk lids and engine compartment hoods.

Referring initially to FIGS. 2 and 3A-3C, latch mechanism 40 of closure latch assembly 20 is shown located within a latch housing 42 and configured as a ratchet-pawl arrangement having a ratchet 44 and the pawl assembly 46. Ratchet 44 is pivotably mounted via a ratchet pivot post 48 to a plate section 50 of latch housing 42. Likewise, pawl assembly 46 is pivotably mounted via a main pawl pivot post 54 to plate section 50 of latch housing 42. A frusto-trapezoidal notch or channel, commonly referred to as fishmouth 60, is formed in plate segment 50 of latch housing 42 and is configured to receive striker 31 upon movement of door 14 toward its closed position. Specifically, striker 31 is configured to engage a striker retention slot 62 and a striker capture notch 64 formed in ratchet 44.

Figure 2B:
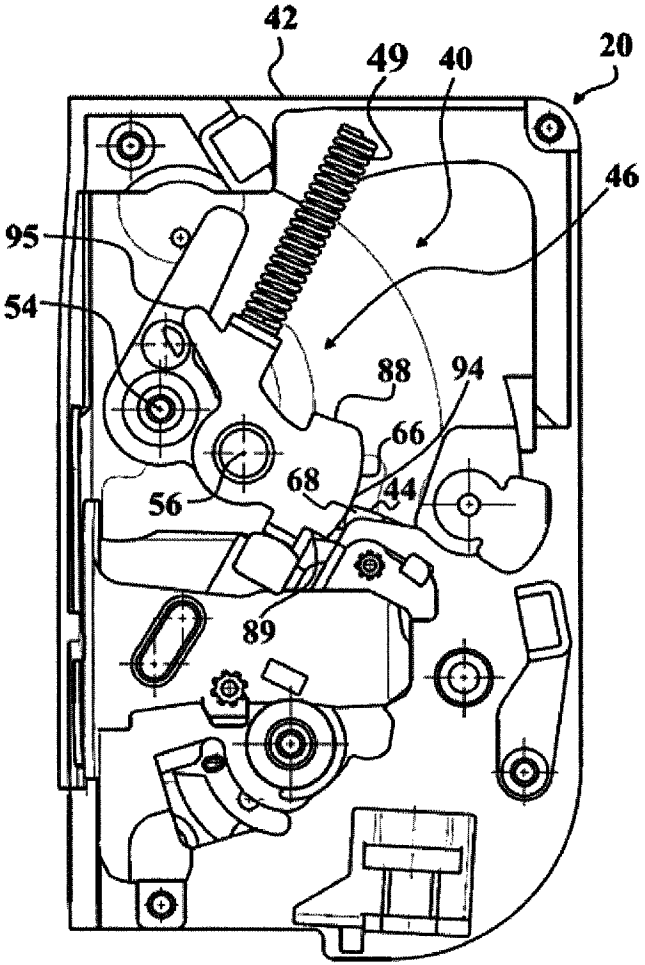
FIG. 2B is a rear plan view of the closure latch assembly of FIG. 2A.
Figure 2A:
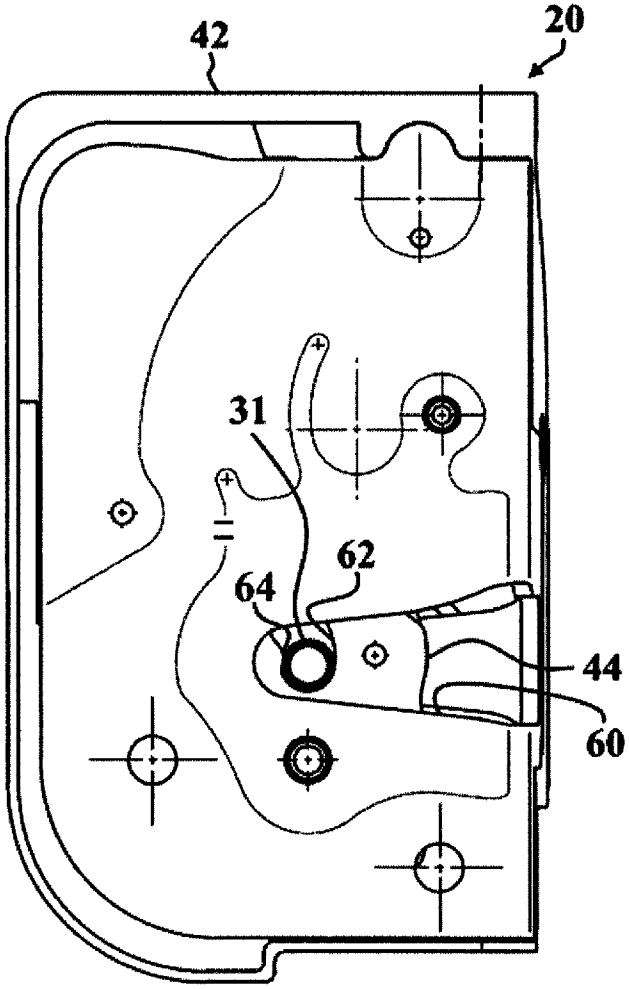
FIG. 2A is a front plan view of the closure latch assembly shown fixed on a edge face of the door of the motor vehicle of FIG. 1.
Figure 3:
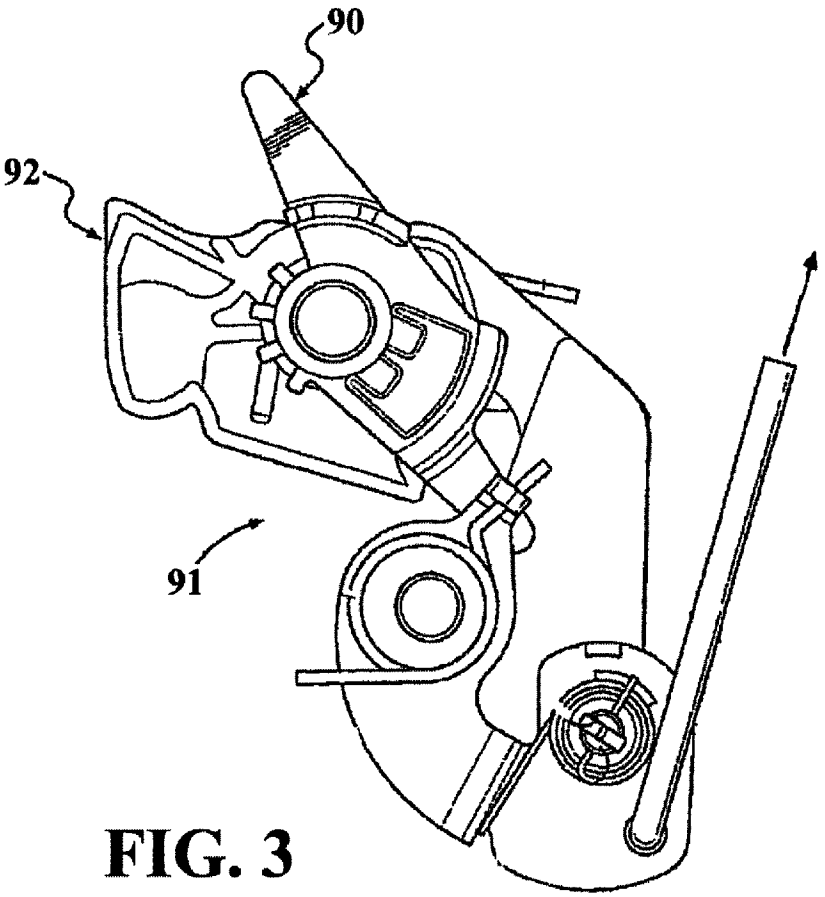
FIG. 3 is a plan view of a handle-actuated release mechanism, a lock lever and a latch release mechanism within the closure latch assembly.

Ratchet 44 is shown in FIG. 3A rotated by striker 31 to a primary striker capture position with pawl assembly 46 located in a ratchet holding position, also known as a ratchet checking position, such that a latch shoulder 66 formed on pawl assembly 46 engages a first ratchet locking surface, also referred to as primary latch notch 68, formed on ratchet 44, whereby striker 31 is held within striker capture notch 64. Ratchet 44 is shown in FIG. 3B rotated to a secondary striker capture position with pawl assembly 46 again located in its ratchet holding position such that latch shoulder 66 on pawl assembly 46 now engages a second ratchet locking surface, also referred to as secondary latch notch 70, formed on ratchet 44, whereby striker 31 is located within retention slot 62. Finally, ratchet 44 is shown in FIG. 3C rotated to a striker release position and pawl assembly 46 is shown located in a ratchet releasing position. Pawl assembly 46 is normally biased toward its ratchet holding position via a pawl biasing member, shown by way of example and without limitation as a pawl spring shown schematically in FIGS. 2, 5-8 by arrow 72, while ratchet 44 is normally biased toward its striker release position via a ratchet biasing member, shown by way of example and without limitation as a ratchet spring shown schematically by arrow 74. FIG. 3A illustrates closure latch assembly 20 operating in a primary latched mode with door 14 fully closed. FIG. 3B illustrates closure latch assembly 20 operating in a secondary latched mode with door 14 partially closed. FIG. 3C illustrates closure latch assembly 20 operating in an unlatched mode with door 14 permitted to move to its open position.

FIG. 2 illustrates pawl assembly 46 to further include a pawl lug segment 76 which extends through a slot 78 formed in plate section 50 of latch housing 42. The locking mechanism associated with closure latch assembly 20 is operable to releasably retain pawl assembly 46 in its ratchet holding position. The lock mechanism includes a lock lever 90 (FIG. 4) that is moveable (manually or via a power-operated lock actuator) between a first or "unlocked" position and a second or "locked" position with respect to pawl lug segment 76 of pawl assembly 46. With lock lever 90 located in its unlocked position, a "latched/unlocked" mode is established for closure latch assembly 20 such that movement of pawl assembly 46 to its ratchet releasing position is permitted. In contrast, location of lock lever 90 in its locked position establishes a "latched/locked" mode for closure latch assembly 20 and prevents movement of pawl assembly 46 to its ratchet releasing position. Additionally, the latch release mechanism 91 associated with closure latch assembly 20 is operable to move pawl assembly 46 from its ratchet holding position into its ratchet releasing position to establish the unlatched mode. The latch release mechanism 91 includes a pawl release lever, also referred to as latch release lever 92 (FIG. 4), that is moveable (manually and/or via a power-operated release actuator) between a first or "rest" position and a second or "actuated" position with respect to pawl lug segment 76 of pawl assembly 46. With latch release lever 92 located in its rest position, the latched/unlocked mode is established with pawl assembly 46 maintained in its ratchet holding position. In contrast, movement of latch release lever 92 to its actuated position causes pawl assembly 46 to move to its ratchet releasing position which, in turn, permits ratchet 44 to rotate to its striker release position for establishing the unlatched mode.

The inside handle-actuated release mechanism and the outside handle-actuated release mechanism associated with closure latch assembly 20 are configured to directly or indirectly cause movement of pawl assembly 46 from its ratchet holding position to its ratchet releasing position which, in turn, permits ratchet spring 74 to move ratchet 44 to its striker release position. FIG. 1 schematically illustrates a release cable 22 interconnecting inside door handle 16 to the inside release mechanism within closure latch assembly 20. Obviously, alternative arrangements for mechanically interconnecting inside door handle 16 to the inside latch release mechanism within closure latch assembly 20 are contemplated and available.

Pawl assembly 46, as noted above, is provided as a two-component assembly including a primary pawl lever, also referred to as first or main pawl 80, and a secondary pawl lever, also referred to as second pawl 82. Main pawl 80 is provided having a planar or substantially planar body (meaning the body may not be purely planar, but generally has opposite face surfaces that would ordinarily be construed as being parallel with one another, thereby defining a planar body) pivotally attached to plate section 50 via main pawl pivot post 54. Main pawl 82 has a pawl extension, also referred to as pawl arm 83 extending along opposite sides 84, 85 away from main pawl pivot post 54 to a free end 86 and further includes pawl lug segment 76 extending away from pawl pivot post 54 for operable engagement with latch release lever 92. Main pawl pivot post 54 is located between the pawl arm 83 and pawl lug segment 76. Free end 86 is shown as being inclined in oblique relation to opposite sides 84, 85, defining an oblique surface extending therebetween with free end 86 shown as being generally planar, by way of example and without limitation. Main pawl 80 can be formed of any desired high strength, tough, impact resistant material, such as a high strength, impact resistant metal, including steel or aluminum, by way of example and without limitation, although high strength, impact resistant polymeric materials are contemplated herein.

Figure 5B:
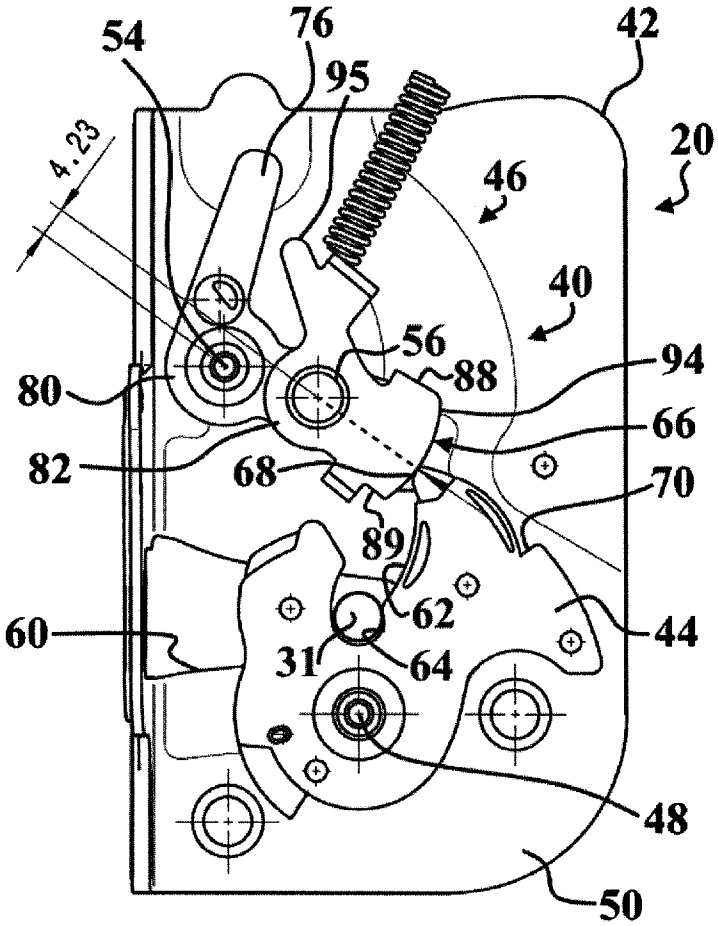
FIG. 5B is a rear plan view of the latch mechanism as illustrated in FIG. 5A.
Figure 5A:
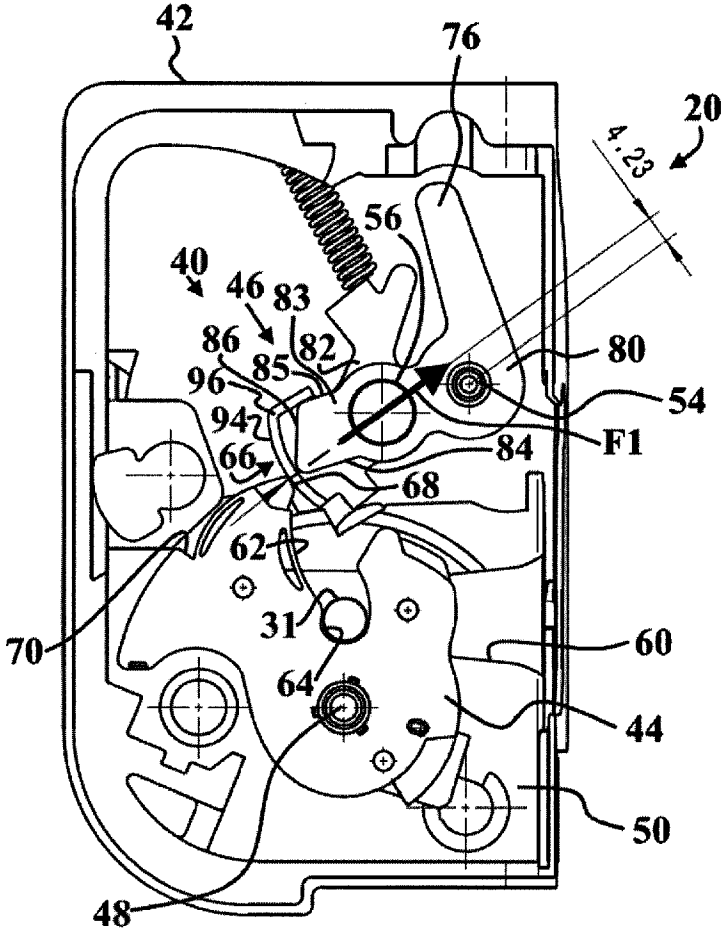
FIG. 5A is a view similar to FIG. 4A showing a first pawl of a pawl assembly of the latch mechanism during an initial stage of being actuated.
Figure 8B:
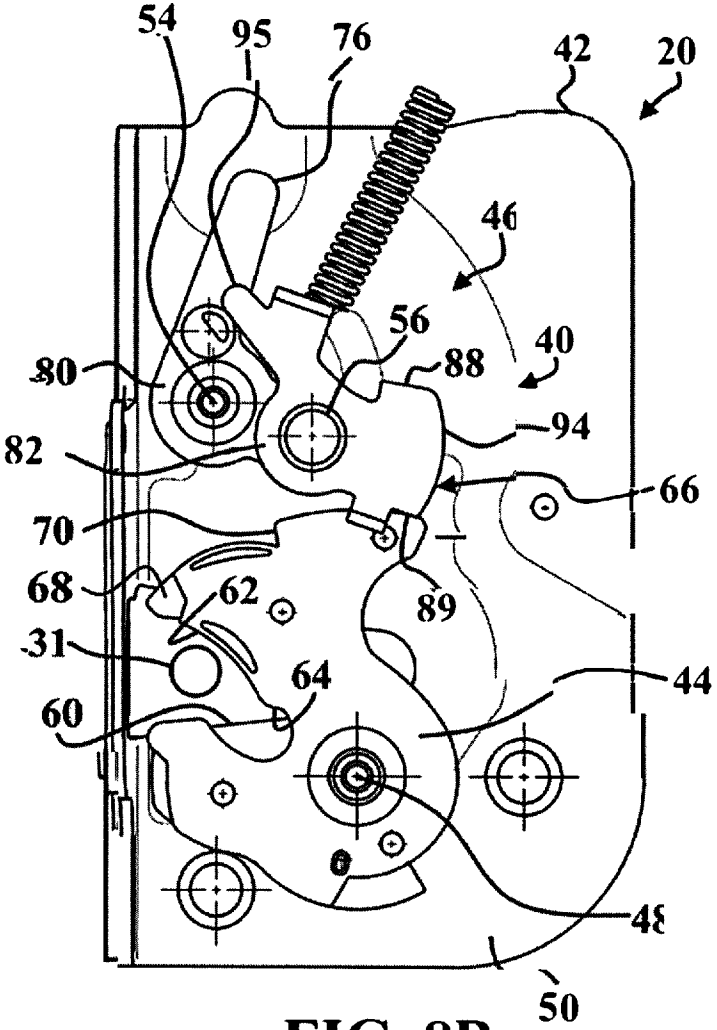
FIG. 8B is a rear plan view of the latch mechanism as illustrated in FIG. 8A.
Figure 8A:
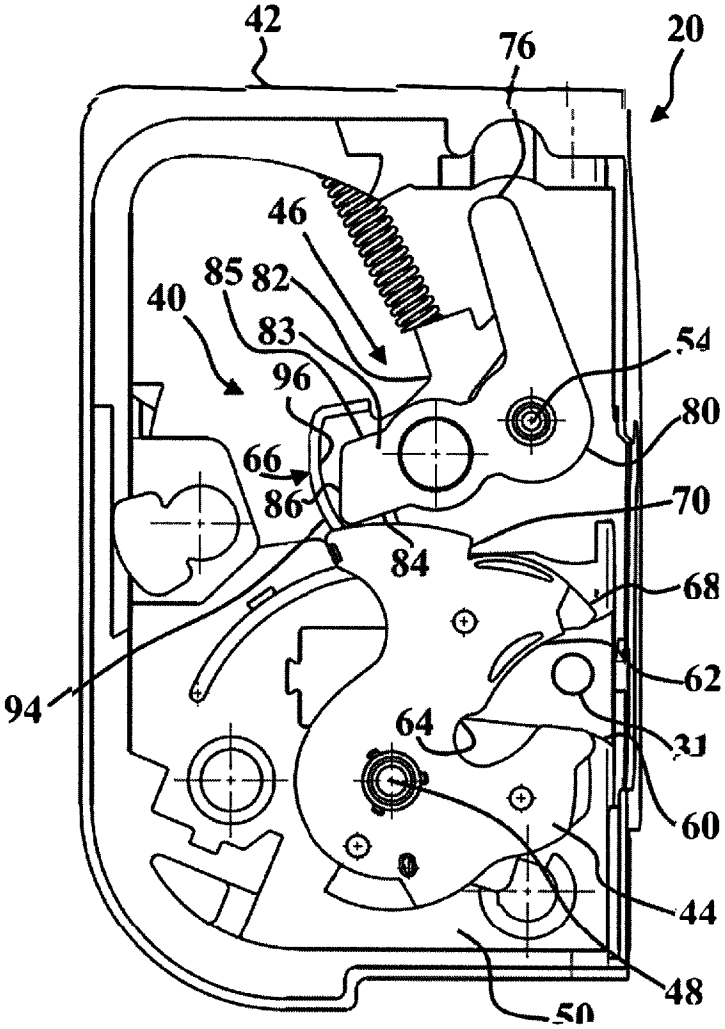
FIG. 8A is a view similar to FIG. 7A illustrating the pawl assembly and ratchet of the closure latch assembly while in an open position.

Second pawl 82 is provided having a planar or substantially planar body (meaning the body may not be purely planar, but generally has opposite sides that would ordinarily be construed as being parallel with one another, thereby defining a planar body) pivotally attached to main pawl 80 via second pawl pivot post 56. Second pawl pivot post 56 extends through or extends from a face of pawl arm 83 and is located between main pawl pivot post 54 and free end 86 of pawl arm 83. As such, second pawl 82 lies generally parallel in overlying relation with first pawl 80 along one of the face surfaces of first pawl 80 for relative pivotal movement there against or there along, as discussed further hereafter. Second pawl 82 has opposite sides 88, 89 extending lengthwise between opposite free ends 94, 95. Free end 94 is located adjacent free end 86 of pawl arm 83, and is shown as extending slightly beyond free end 86, such that the distance from second pawl pivot post 56 to free end 94 is slightly greater than the distance extending from second pawl pivot post 56 to free end 86. Free ends 94, 95 are shown as extending generally perpendicular to opposite sides 88, 89, thereby rendering second pawl 82 generally rectangular, by way of example and without limitation. Second pawl pivot post 56 extends through or extends from a face of second pawl 82 and is located between free ends 94, 95 of second pawl 82, shown as being equidistant or approximately equidistant between free ends 94, 95, by way of example and without limitation. The at least one spring member 72 (shown schematically in FIGS. 5 and 7-8) acts on main pawl 80 and second pawl 82 to bias pawl assembly 46 toward its ratchet holding position (FIG. 5). Second pawl 82 is formed of a suitably strong material to function as desired without deformation during normal use, such as from a suitable metal or polymeric material; however, as shown in FIG. 8, the material of the free end 94 is intended to deform and collapse along the length of the second pawl 82, such that the primary latch notch or surface 68, rather than engaging free end 86 of second pawl 82, is brought into engagement with free end 94 of main pawl, as discussed further below.

Figure 4B:
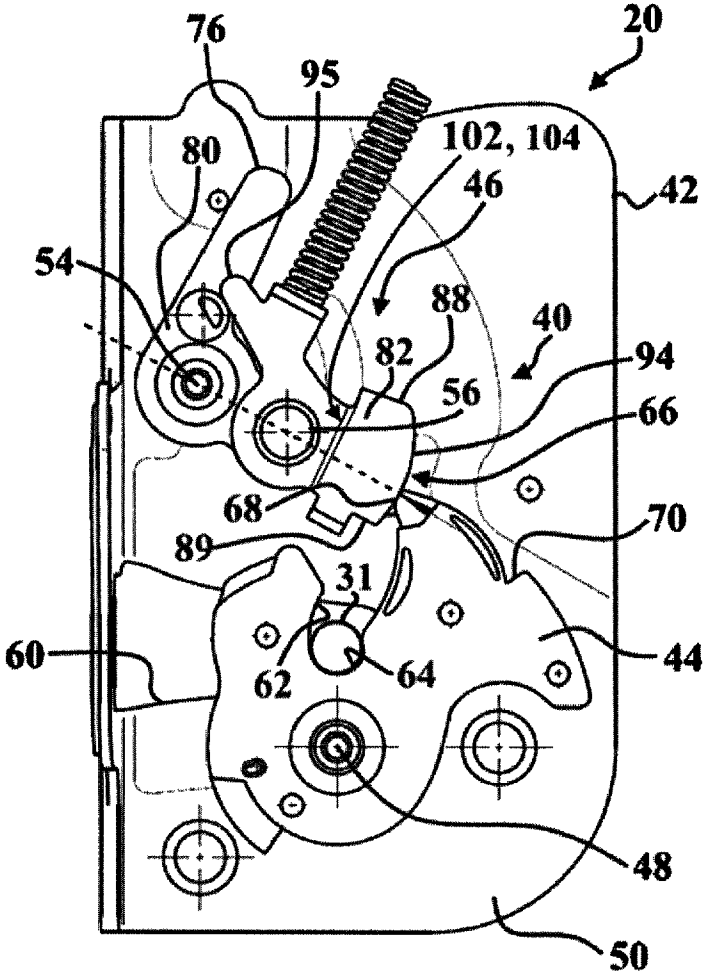
FIG. 4B is a rear plan view of the latch mechanism as illustrated in FIG. 4A.
Figure 4A:
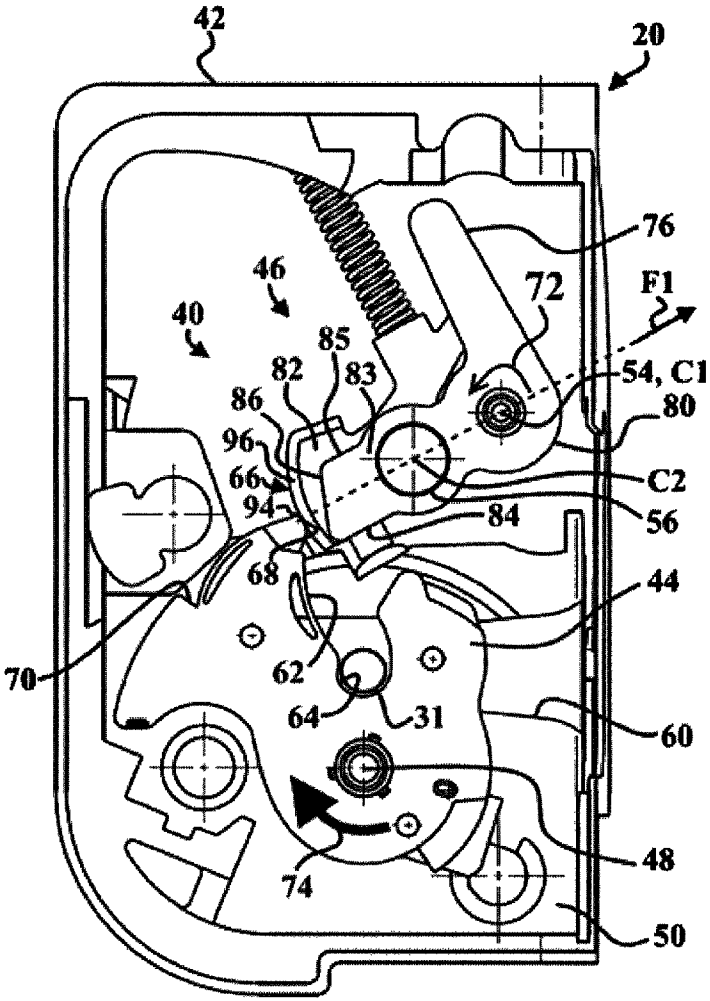
FIG. 4A is a front plan view of a latch mechanism associated with the closure latch assembly of the present disclosure shown in a fully closed position.
Figure 4C:
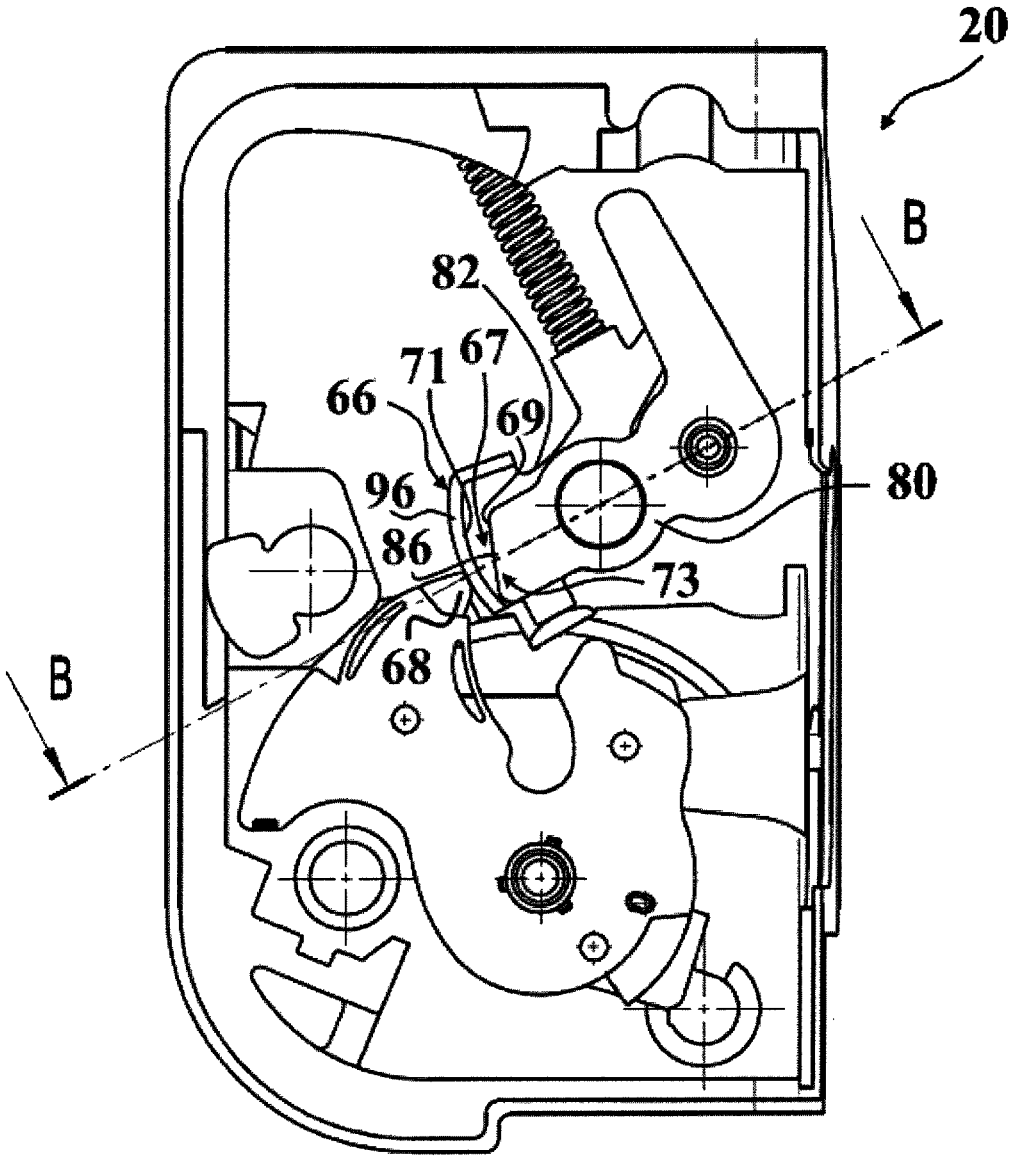
FIG. 4C is a front plan view of a latch mechanism of FIG. 4A illustrating a gap provided between a first pawl and a second pawl, in accordance with an illustrative example.
Figure 4D:
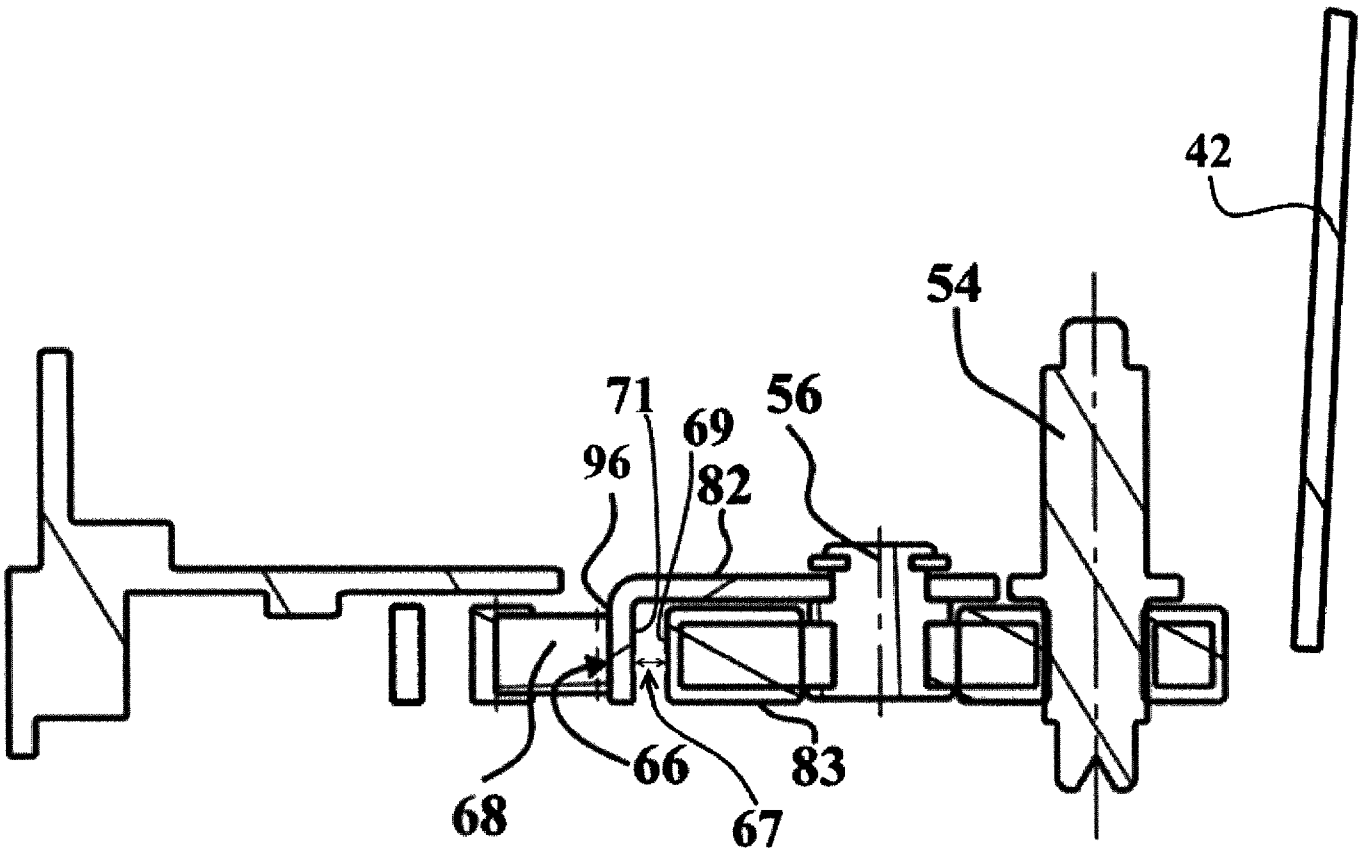
FIG. 4D is a cross-sectional view taken along the line B-B of FIG. 4C illustrating the gap between the first pawl and the second pawl.

Referring now to FIGS. 4A to 4E, there is illustratively shown a gap 67 provided between the first pawl 80 and the second pawl 82, the gap provided to allow relative movement of the latch shoulder 66 towards an abutment surface 69 of the main pawl 80 during a crash or accident event. For example, gap 67 is defined between an inner surface 71 of the latch shoulder 66 and a free end 73 of the first pawl 80. Closing of gap 67 during a crash event, such as when the striker 31 imparts a sufficiently high force, for example a force greater than normally experienced by the latch assembly 20 during normal operation such as for example a force acting on the ratchet 44 due to seal loading or due to the bias from ratchet spring 74 or due to road vibrations or pressure differentials between the interior of the vehicle and the exterior of the vehicle as examples, tending to urge the ratchet 44 to move from the striker capture position towards a striker release position. As a result of a deformable portion 100 provided with or formed as part of the pawl assembly 46 experiencing a deformation under such a crash loading event in response to the ratchet imparting on the pawl assembly 46 the sufficiently high force, the pawl assembly 46 allows the ratchet 44 to move from its first striker capture position, known as the primary latched position in the art, as shown in FIG. 4A to a second striker capture position as shown in FIGS. 4F, 4J, and 4K for example, and illustratively over a travel amount represented by angle 297. The second striker capture position may be provided at an angular position before a secondary latched position of the ratchet 44 as known in the art, and for example without a releasing movement or substantial movement, such as a clockwise releasing movement as viewed in FIG. 4E, of the pawl assembly 46 towards the ratchet releasing position due to for example activation of pawl lug segment 76. Rather 44 may move from the first striker capture position (FIG. 4A, 4D, 4G, 4I) to the second striker capture position (FIG. 4F, 4H, 4J, 4K) without an intentional releasing activation of the pawl assembly 46. Engagement of the inner surface 71 of the latch shoulder 66 and a free end 73 of the first pawl 80 illustratively functions as a hard stop of the ratchet 44 in the second striker capture position, and limits further travel of the free end 94 towards said pivot axis 55, such that the high crash loading forces acting on the pawl assembly 46 as a result of the striker 31 urging the ratchet 44 to pivot to the striker release position cannot further pivot the ratchet 44 away from the second striker capture position and towards the striker release position. As a result, a controlled movement of the ratchet 44 is allowed to occur during a crash event that places the pawl assembly 46 in a locked state or locking relation to prevent the pawl assembly 46 from transitioning to a ratchet releasing position during the crash condition or event whereat the striker 31 is permitted to move the ratchet 44 to the striker release position. Such a controlled movement of the ratchet 44 by the deformation of the pawl assembly 46 may result a slight angular 297 rotation of the ratchet 44 between the first striker capture position and the second striker capture position and without a large enough rotation to release the striker 31 from the fishmouth 60 e.g. without the ratchet moving to the secondary latched position or to the ratchet releasing position for example.

Figure 4E:
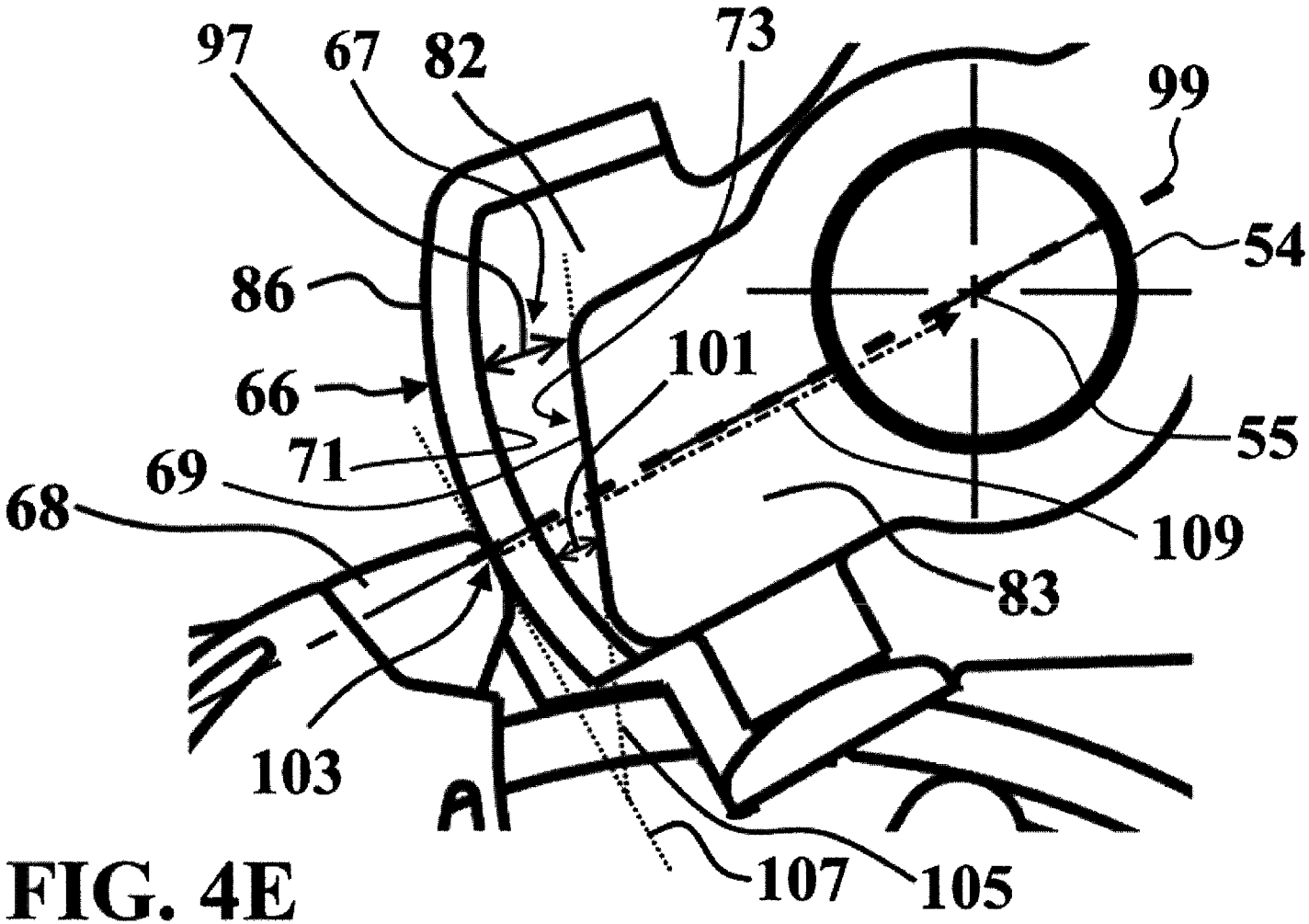
FIG. 4E is a close up front plan view of the ratchet engaging the second pawl of FIG. 4C during a non-crash state.
Figure 4F:
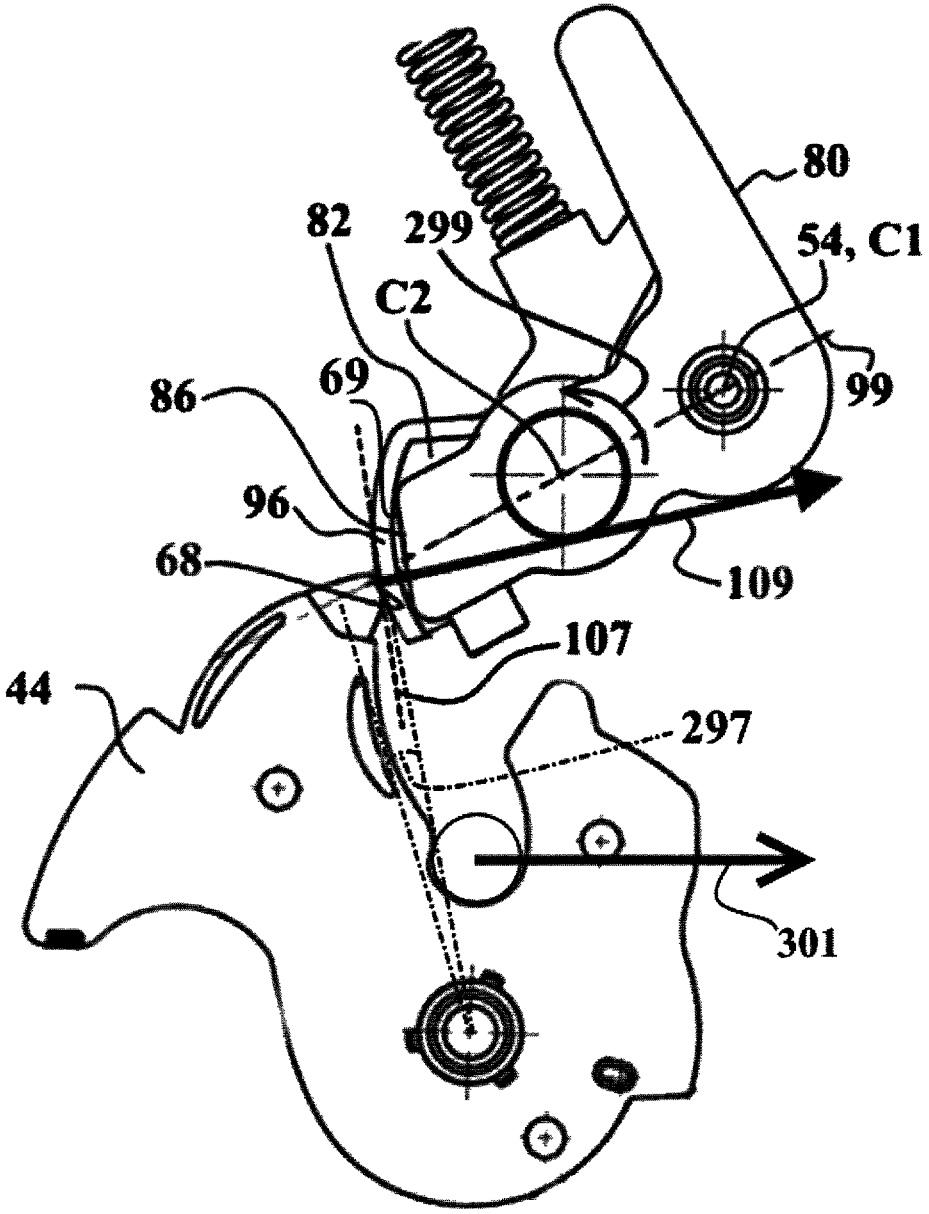
FIG. 4F is an isolated view showing a deformation of the pawl assembly of FIG. 4A during a crash state, in accordance with an illustrative embodiment.

Now referring to FIG. 4E, there is illustrated an example of a non-uniform gap 67 such that the distance between the inner surface 71 and the abutment surface 69 varies along their radially extending lengths. For example, the distance 97 between the inner surface 71 and the abutment surface 69 increases (for example moves away from one another) away from a line 99 extending from a contact point 103 of the ratchet 44 on the face (presented to and facing ratchet 44) of lip 96 of free end 94 through the pivot axis 55 of pivot post 54, illustratively as being the distances above the line 99 in FIG. 4E, and the distance 101 between the inner surface 71 and the abutment surface 69 decreases (for example moves towards each other) away from a line 99 extending from a contact point 103 of the ratchet 44 on the face (presented to and facing ratchet 44) of lip 96 of free end 94 through the pivot axis 55 of pivot post 54, illustratively as being the distances below the line 99 in FIG. 4E. Such a non-uniform gap 67 is formed as a result of an exemplary configuration of the free end 73 of the first pawl 80, having an acutely angled surface relative to the line 99 extending away from the pivot axis 55 of pivot post 54, as illustrated by line 105 extending in a parallel direction to the obliquely angled abutment surface 69 and intersecting line 107 provided at a perpendicular angle to line 99. Upon deformation of the deformable portion 100 the surface of the free end 94, and for example the lip 96, facing the ratchet 44 may partially alter in shape (see FIG. 4K) (FIG. 4K) or adopt a different angle (see FIG. 4F) to present to the ratchet 44 an angled surface e.g. acutely angled relative to line 99 extending from a contact point 103 of the ratchet 44 on the surface of lip 96 through the pivot axis 55.

In a neutral state of the pawl assembly 46 engagement with the ratchet 44 as shown in FIGS. 4A and 4E for example, the force 109 imparted by the ratchet 44 on the pawl assembly 46, and for example shown as the force imparted at a contact point 103 on the face of free end 94 of second pawl 82 is directed as represented by a force vector 109 towards the pivot axis 55 and being perpendicular to surface of free end 94 at contact point 103 with the surface of free end 94 extending parallel to line 107 at the contact point 103 when second pawl 82 is in its ratchet checking position as shown in FIGS. 4A and 4E, such that the force vector 109 does not cause a torque on the pawl assembly 46 about the pivot post 54 to cause an urging of the pawl assembly 46 to move towards either the ratchet releasing position (shown as being in the clockwise direction about pivot axis 55 in FIG. 4E) or the ratchet checking or ratchet holding position (shown as being in the counterclockwise direction about pivot axis 55 in FIG. 4E). Free end 94 is shown in FIG. 4E at least to have a curved surface centered about pivot axis 55 such that upon a pivoting of second pawl 82, the surface facing the ratchet 44 of free end 94 at the contact point 103 will adopt an angled position relative line 107 such that the angle of applied force of the ratchet 44 on the pawl assembly 46 as represented by force vector 109 will be shifted away from pivot axis 55 in response to the shift in the orientation of the free end 94, for example as shown in FIG. 6A illustrating a change in direction of the force vector 109 away (e.g. upwardly as seen in FIG. 6A) from its parallel direction along line 99 when the latch assembly 20 is in the rest position and the pawl assembly 46 is in the ratchet holding position as shown in FIGS. 4A and 4E. Therefore, when the ratchet 44 is in the first striker capture position and the pawl assembly 46 is in the ratchet checking or holding position, the ratchet 44 acting on the pawl assembly 46 for example caused by a seal loading or a spring loading during a non-crash event or condition results in a net zero torque on the pawl assembly 46. As a result of such a net zero torque during a rest position of the pawl assembly 46 when in the ratchet checking position, a releasing action due to the pivot of latch release lever 92 causing concurrent pivotal movement of pawl lug segment 76 and pawl arm 83 fixed thereto in a clockwise (CW) direction as described herein above directly transitions the pawl assembly 46 into a self-releasing state (meaning for example that the rotation of the ratchet 44 acts to move the pawl assembly 46 towards the ratchet releasing position) due to the variation or alteration in the angle of attack of the ratchet 44 on free end 94 and thus a shift in direction of the force vector 109 offset the pivot axis 55 occurs, and illustratively such a shift is represented by the vector 109 moving above the line 99 as shown in FIG. 6A such that the force vector 109 causes a clockwise torque as viewed in FIG. 6A, or an opening or releasing torque, on the pawl assembly 46 about the pivot post 54 urging the pawl assembly 46 to move towards the ratchet releasing position (shown as being in the clockwise direction about pivot axis 55 in FIG. 4E). As this variation or shifting in ratchet applied force 109 is gradual compared to an instantaneous disengagement or "slip" of know single ratchet and pawl configurations, pop-out noised caused by rapid seal load decompression is reduced. With reference to the illustrated embodiment of FIG. 2B spring bias 49 acting on second pawl 82 may also assist with reducing the rate of variation in the angle of attack of the ratchet 44 during a release of the dual-pawl assembly configuration described herein. The direct transition the pawl assembly 46 into a self-releasing state from its neutral position results in reduces the force required to move the pivot of latch release lever 92 to transition the pawl assembly 46 into a self-releasing state and thus lower release efforts, either manual or motorized, since the pivoting of latch release lever 92 is only required to transition the pawl assembly 46 into the self-releasing state, and not having to overcome any closing torques when the pawl assembly 46 is in the ratchet checking position and the ratchet 44 is in its first striker capture position. Also, since the rest position of the pawl assembly 46, that is when the latch assembly 20 is in the primary latched state and for example when the ratchet 44 is being held by the pawl assembly 46 in its ratchet holding position to maintain the ratchet 44 in the first striker capture position during a non-crash condition, the pawl assembly 46 is in a neutral or balanced state, for example no net torque is acting on the pawl assembly 46, and pawl assembly 46 is not in a closing state e.g. a net closing torque resulting from the configuration of a ratchet and a pawl tending to urge a pawl assembly towards the ratchet holding or checking position when the ratchet is in a primary striker capture position as known in the art. Therefore, a pivoting of latch release lever 92 does not have to overcome such net closing torques of existing latches when in its rest state when the pawl would be in a ratchet holding position and the ratchet in the primary striker capture position, before the pawl assembly can be transitioned to a self-releasing state. The provided configuration described herein may therefore allow the pawl assembly 46 to be subjected to a net closing torque, illustrated as counter clockwise arrow 299 in FIG. 4F only in response to a crash event during which it is desirable to establish a net closing torque of the pawl assembly 46 with the ratchet 44 to prevent inadvertent releasing of the striker 31, while during a no-crash event or a normal operating condition the pawl assembly is configured in a neutral state to lower the release efforts to a user (e.g. manual release) or reduce the size of a motor or energy used by a motor (e.g. a motorized release). However, recognizing that increasing release efforts may be required for pivoting of latch release lever 92, the current teachings herein may provide for a net closing torque when the pawl assembly 46 is in a ratchet holding position and the ratchet is in the first striker capture position.

Figure 4G:
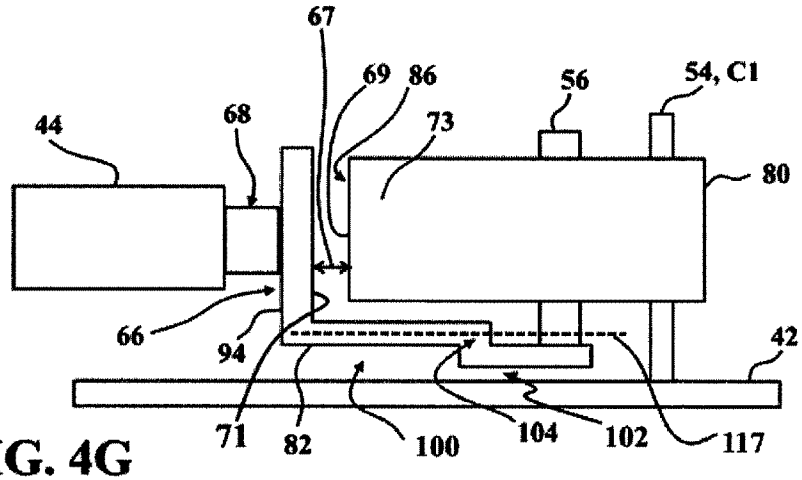
FIG. 4G is a cross-sectional view of FIG. 4E illustrating an example of a deformable portion of the pawl assembly, in accordance with an illustrative embodiment.
Figure 4H:
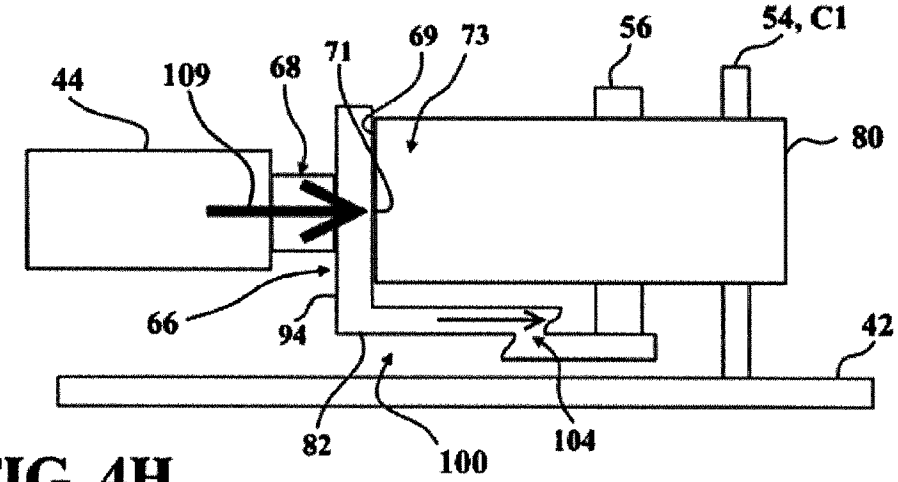
FIG. 4H is a cross-sectional view of FIG. 4F illustrating a deformation of the deformable portion of FIG. 4G, in accordance with an illustrative embodiment.
Figure 4I:
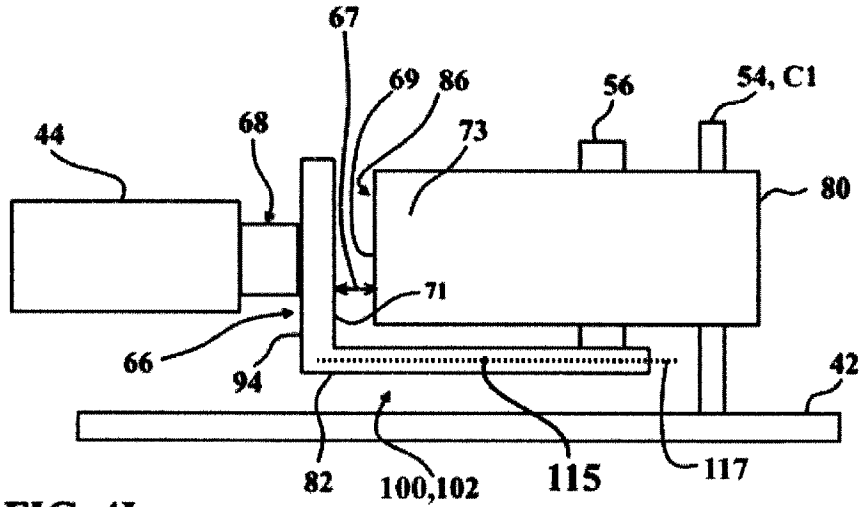
FIG. 4I is a cross-sectional view of FIG. 4E illustrating another example of a deformable portion of the pawl assembly, in accordance with an illustrative embodiment.
Figure 4J:
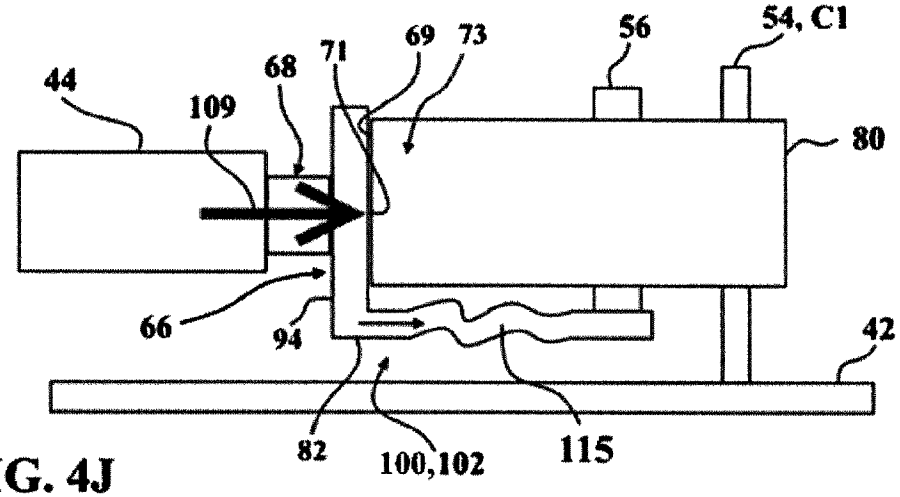
FIG. 4J is a cross-sectional view similar to FIG. 4I illustrating a deformation of the deformable portion of FIG. 4I, in accordance with an illustrative embodiment.
Figure 4K:
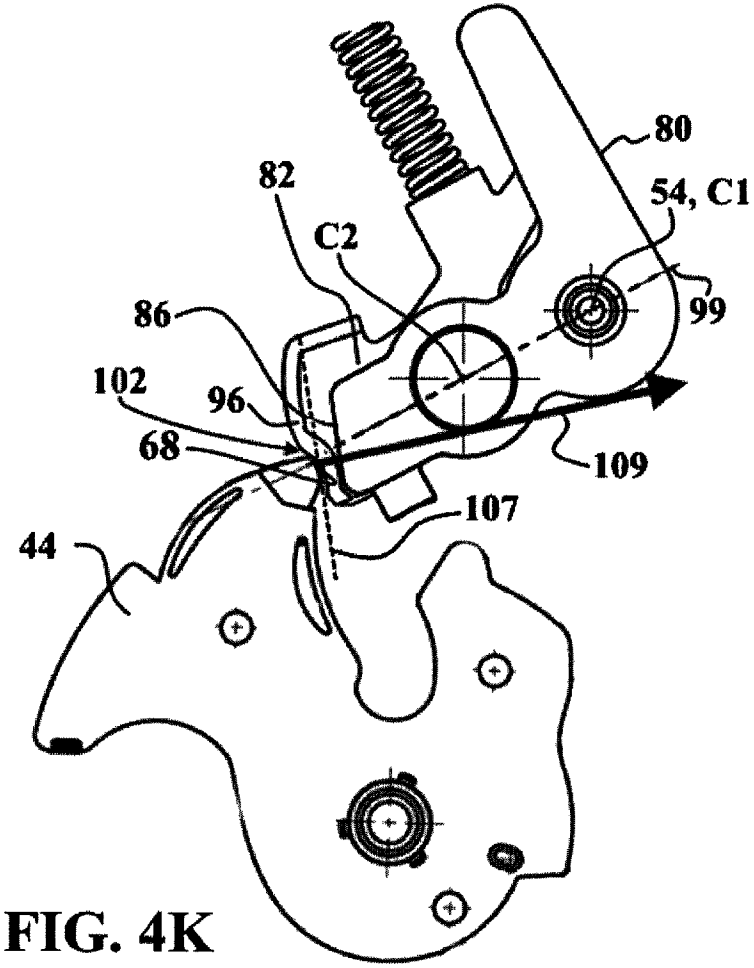
FIG. 4K is a partially isolated view of the latch mechanism of FIG. 4A illustrating a deformation of a deformable portion, in accordance with another illustrative embodiment.

Now referring to FIG. 4F to FIG. 4H there is illustrated the latch assembly 20 experiencing a crash condition or event, for example as a result of a roll-over condition of the vehicle causing the striker 31 to be pulled to urge the ratchet 44 towards the striker releasing position. Free end 94 is illustrated as being engaged with the ratchet locking surface 68 while the pawl assembly 46 is in the ratchet checking position to releasably maintain the ratchet 44 in the second striker capture position as a result of deformable portion 100 of the pawl assembly 46 undergoing a deformation resulting in a reduction in the overall length of the second pawl 82 for example and thereby allowing the ratchet 44 to pivot from the first striker capture (FIG. 4A) position to the second striker capture position (FIG. 4F and FIG. 4G) over angle 297 in response to the ratchet 44 pivoting e.g. clockwise as shown in FIG. 4F, during a crash event. Ratchet 44 is prevented from further pivoting to the ratchet releasing position during the crash event as a result of pawl assembly 46 engaging the ratchet 44 in a manner as now described. Pawl assembly 46 is illustrated to include a deformable portion 100 which is illustratively provided as part of the second pawl 82. Deformable portion 100 is illustratively provided as a predetermined deformable area 102 formed on second pawl 82, and shown for example in an adjacent partial overlapping arrangement with main pawl 80, such as a preformed bend 104 extending between opposite ends 84, 85 configured to buckle, such as further bend in a direction out of plane of the second pawl 82 above the application of a crash load imparted by the ratchet 44 onto the second pawl 82, causing the critical load of the deformable portion 100 to be exceed. Other types of deformation are contemplated by the present disclosure and include but are not limited to crushing, buckling, bending, cracking, plastic deforming, permanent deforming, elastic deforming, shearing, collapsing, splintering and the like. The material composition and configuration (e.g. processing such as forming the bend as described above for example) of the second pawl 82 may be chosen to provide such deformation characteristics. For example second pawl 82 is illustratively formed from metal, but other materials, such as a composite material, a polymer material, or a hybrid or combination of materials may also be provided. In accordance with the illustrative example, second pawl 82 may be formed from a sheet of material formed during a blanking process which may involve forming a predetermined area of deformation 102, such as by providing a bend 104 in the second pawl 82 extending generally perpendicular to opposite sides 88, 89, for example as shown in FIG. 4B and FIG. 4G. In accordance with another illustrative example, second pawl 82 may include a planar member 115, illustratively formed from sheet metal for example as will be described in details herein below, extending along a longitudinal axis illustrated as line 117 extending between free end 94 towards the pivot post 56, provided without a bend and which may undergo deformation as an out-of-plane buckling deformation as shown in FIG. 4H for example at one localized area or at multiple areas along the planar member 115 to allow the gap 67 to close, that is to allow the inner surface 71 to enter into abutting contact with abutment surface 69 during a crash event such that a crash loading imparted by the ratchet 44 on the second pawl 82 causes the deformation of the deformable portion 100 to allow the ratchet 44 to move from the first striker capture position to the second striker capture position without allowing the ratchet 44 to continue to pivot for example towards the ratchet releasing position. In other words, in one illustrative example the deformable portion 100 extends perpendicular to the pivot axis 55. Other types of deformable portions of the pawl assembly 46 may be provided. For example, a deformable portion 100 may be provided on lip 96, as shown in FIG. 4K such that deformable portion 100 extends parallel to the pivot axis 55. In the illustrated examples, the deformable portion 100 may allow the ratchet 44 to engage the pawl assembly 46 when in the second striker capture position at a different orientation as compared to when the ratchet 44 is in the first striker capture position to direct a force e.g. force 109 that is offset from the line 99, and for example that does not pass through the pivot post 54. Such a different orientation may vary the application of the force 109 on the pawl assembly 46 causing in response to such a variation a closing net torque to lock the pawl assembly 46 towards the ratchet holding position upon a continued application of force on the pawl assembly 46 by the ratchet 44.

In use, as discussed above with regard to FIGS. 3A-3C, pawl assembly 46 is actuatable via latch release mechanism to move the closure latch assembly 20 from a fully closed, primary latched state (FIG. 3A), to a partially opened, secondary latched state (FIG. 3B), to a fully opened, unlatched state (FIG. 3C). While in the fully latched stated, the pawl arm 83 of main pawl 80 and the second pawl 82 are aligned with one another along their lengths such that their respective sides 84, 85; 88, 89, are generally parallel with one another, such that a Force F1 (FIG. 5) imparted by primary latch notch 68, under that bias of ratchet spring 74, on free end 94 of second pawl 82 extends lengthwise along a geometric center of main pawl 80 and second pawl 82 through respective first and second pivot axes C1, C2 of main pawl pivot post 54 and second pawl pivot post 56. Accordingly, the force F1 acts normal on the free end 94 of second pawl 82. It is to be recognized that given the slight axial extension of second pawl 82 free end 94 beyond main pawl 80 free end 86, that primary latch notch 68 does not directly engage free end 86 of main pawl 80.

Figure 6B:
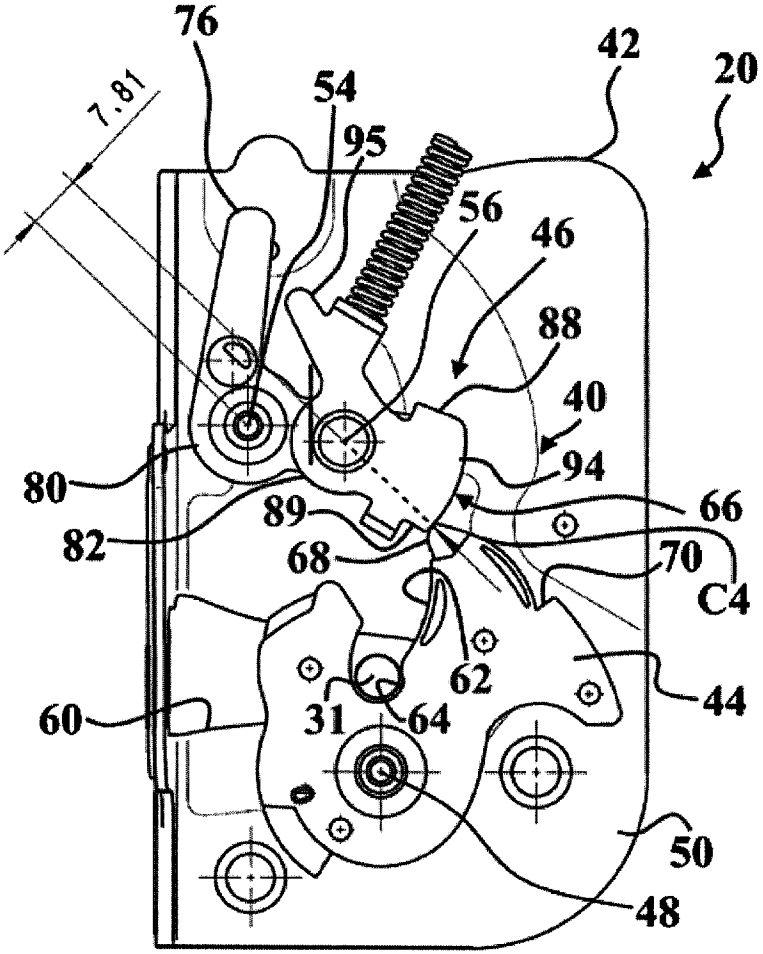
FIG. 6B is a rear plan view of the latch mechanism as illustrated in FIG. 6A.
Figure 6A:
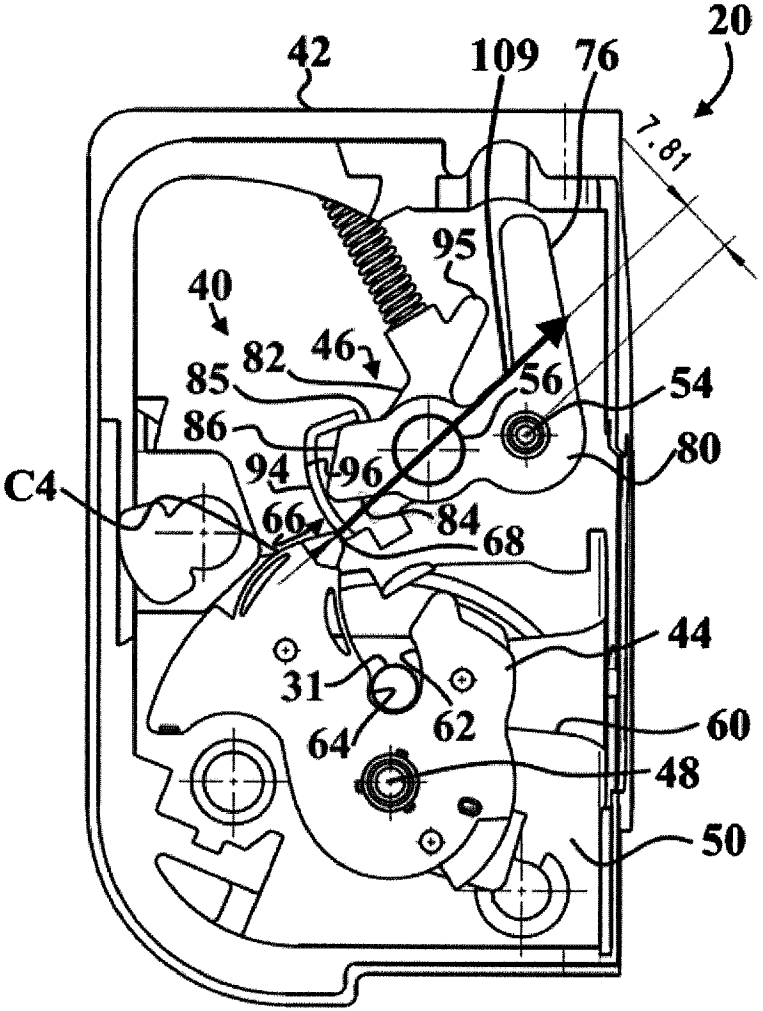
FIG. 6A is a view similar to FIG. 5A showing the first pawl of the latch mechanism in a further actuated state and a second pawl of the pawl assembly in an initial stage of being actuated.
Figure 7B:
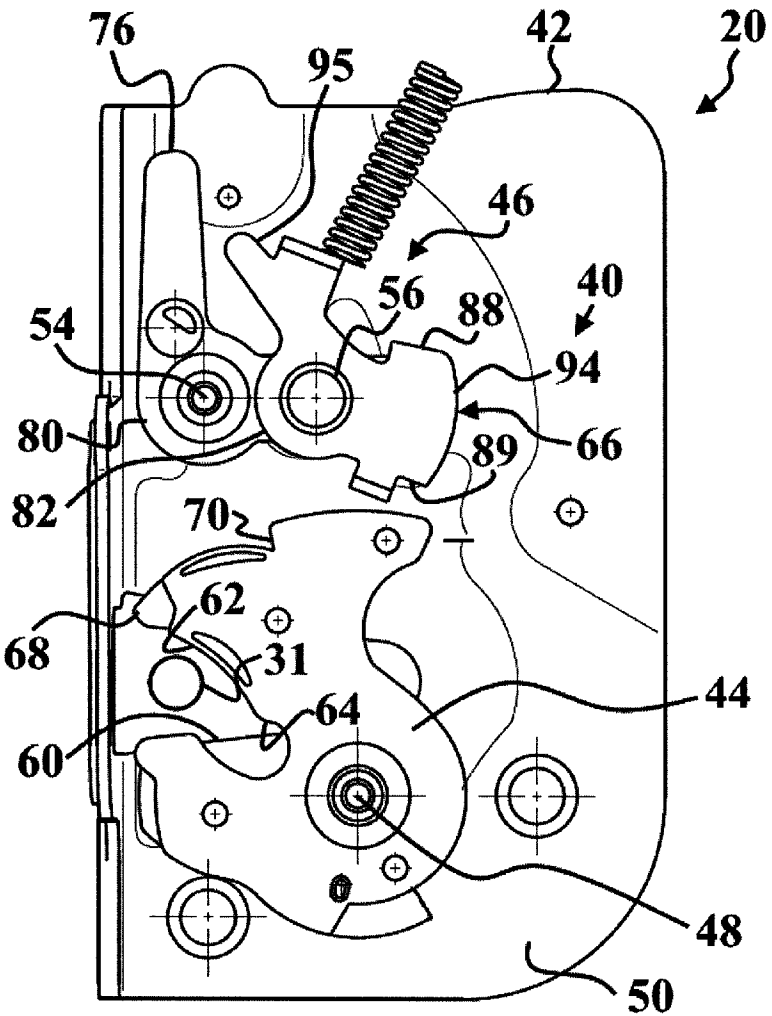
FIG. 7B is a rear plan view of the latch mechanism as illustrated in FIG. 7A.
Figure 7A:
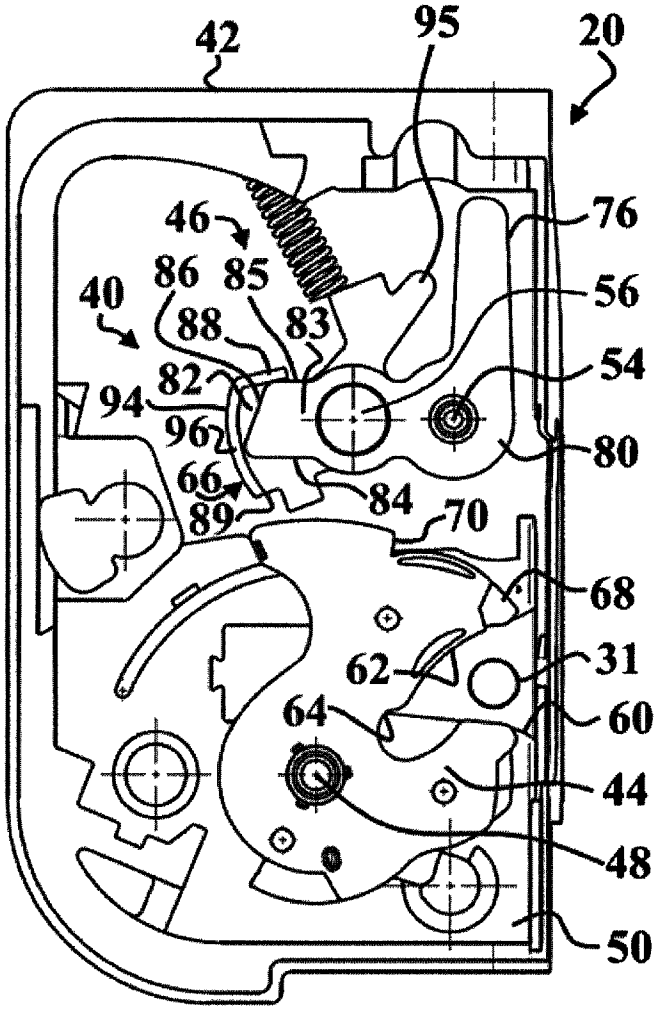
FIG. 7A is a view similar to FIG. 6A showing the first pawl and the second pawl of the pawl assembly in a fully actuated state.

Then, when desired to move closure latch assembly 20 out from its fully closed, primary latched state, latch release mechanism 91 can be selectively actuated (manually and/or via a power-operated release actuator) to pivot latch release lever 92, thereby causing concurrent pivotal movement of pawl lug segment 76 and pawl arm 83 fixed thereto in a clockwise (CW) direction, as viewed in FIG. 6, about first pivot axis C1 of main pawl 80. As main pawl 80 is pivoted CW about first pivot axis C1, free end 86 of main pawl 80 pivots, free from contact with ratchet 44, thereby generating no friction there against, and the direction of force F1 acting on free end 94 of second pawl 82 shifts, and thus, the direction of force F1 no longer extends through second pivot axis C2, but remains extending through first pivot axis C1. As a result, the force F1 no longer is extending along a geometric center of second pawl 82, and thus, a rotational force is imparted on second pawl 82 to cause second pawl 82 to rotate relative to main pawl 80 about second pivot axis C2. During the relative rotation between main pawl 80 and second pawl 82, ratchet 44 is permitted to rotate under the bias of ratchet spring 74 in a CW direction, as viewed in FIG. 6, thus, causing ratchet 44 to move out of its fully closed, primary striker capture position to the secondary striker capture position (FIG. 3B). As ratchet 44 pivots about ratchet pivot post 48, rolling engagement results between a ratchet contact surface C4, 68 and free end 94 of second pawl 82, thus, no sliding friction is generated as illustrated in the sequence of views of FIGS. 6 to 6B (e.g. no sliding interaction between the ratchet contact surface C4, 68 and free end 94 of second pawl 82). Accordingly, smooth rolling movement is generated, which in turn, results in a smooth force gradient as ratchet 44 pivots from the primary striker capture position to the secondary striker capture position, thus, resulting in minimal generation of noise. As the ratchet assembly 46 seats against secondary latch notch 70, spring member 72 causes main pawl 80 and second pawl 82 to realign with one another so that force F1 again extends through both first and second pivot axes C1, C2.

Then, when desired to fully unlatch closure latch assembly 20, latch release mechanism 91 can again be selectively actuated (manually and/or via a power-operated release actuator) to pivot latch release lever 92, thereby causing concurrent pivotal movement of pawl lug segment 76 and pawl arm 83 fixed thereto in a clockwise (CW) direction about first pivot axis C1 of main pawl 80. Thus, as discussed above, main pawl 80 is again pivoted CW about first pivot axis C1 to shift the direction of force F1 acting on free end 94 of second pawl 82 to cause second pawl 82 to rotate relative to main pawl 80 about second pivot axis C2. During the relative rotation between main pawl 80 and second pawl 82, ratchet 44 is permitted to rotate under the bias of ratchet spring 74 in a CW direction, as viewed in FIG. 6, thus, causing ratchet 44 to move out of its secondary striker capture position (FIG. 3B) to its striker release position, thus, moving the closure latch assembly 20 into its unlatched mode. Again, as ratchet 44 pivots about ratchet pivot post 48, rolling engagement results between a ratchet contact surface C4 and free end 94 of second pawl 82, thus, no sliding friction is generated. Accordingly, as ratchet 44 pivots from the secondary striker capture position to the striker release position, minimal generation of noise results. While in the striker release position, the main pawl 80 and second pawl 82 are again realigned with one another under the bias of spring member 98, with the bias also maintaining the pawl assembly 46 in abutment with an outer periphery of ratchet 44. Then, as is known, upon closing the vehicle door 14, striker 31 enters fishmouth 60 and striker retention slot 62, thereby biasing ratchet 44 in counterclockwise CCW direction against the bias of ratchet spring 74 until pawl assembly 46 is returned to its ratchet checking position, also referred to as ratchet hold position.

In accordance with another aspect, as shown in a crash condition (FIG. 9), the force F1 acting between ratchet 44 and pawl assembly 46 generated in the sudden shock of the crash can cause ratchet 44 to effectively deform and crush the free end 94 of second pawl 82, as intended via the construction of second pawl 82, thereby bringing ratchet 44 into operable driving relation (also referred to as operable engagement, meaning the engagement does not need to be direct, but that material of the second pawl 82 may be sandwiched between the ratchet 44 and the main pawl 80) with the oblique free end 86 of main pawl 80. As a result of the free end 86 being inclined in the orientation illustrated, the direction of force F1 shifts to into normal or substantially normal relation with the inclined free end 86, thereby preventing inadvertent pivoting movement of the main pawl 80 in a CW direction to the ratchet release position. Accordingly, the ratchet 44 is held in its striker capture position by operable engagement with free end 86 main pawl 80.

Figure 9:
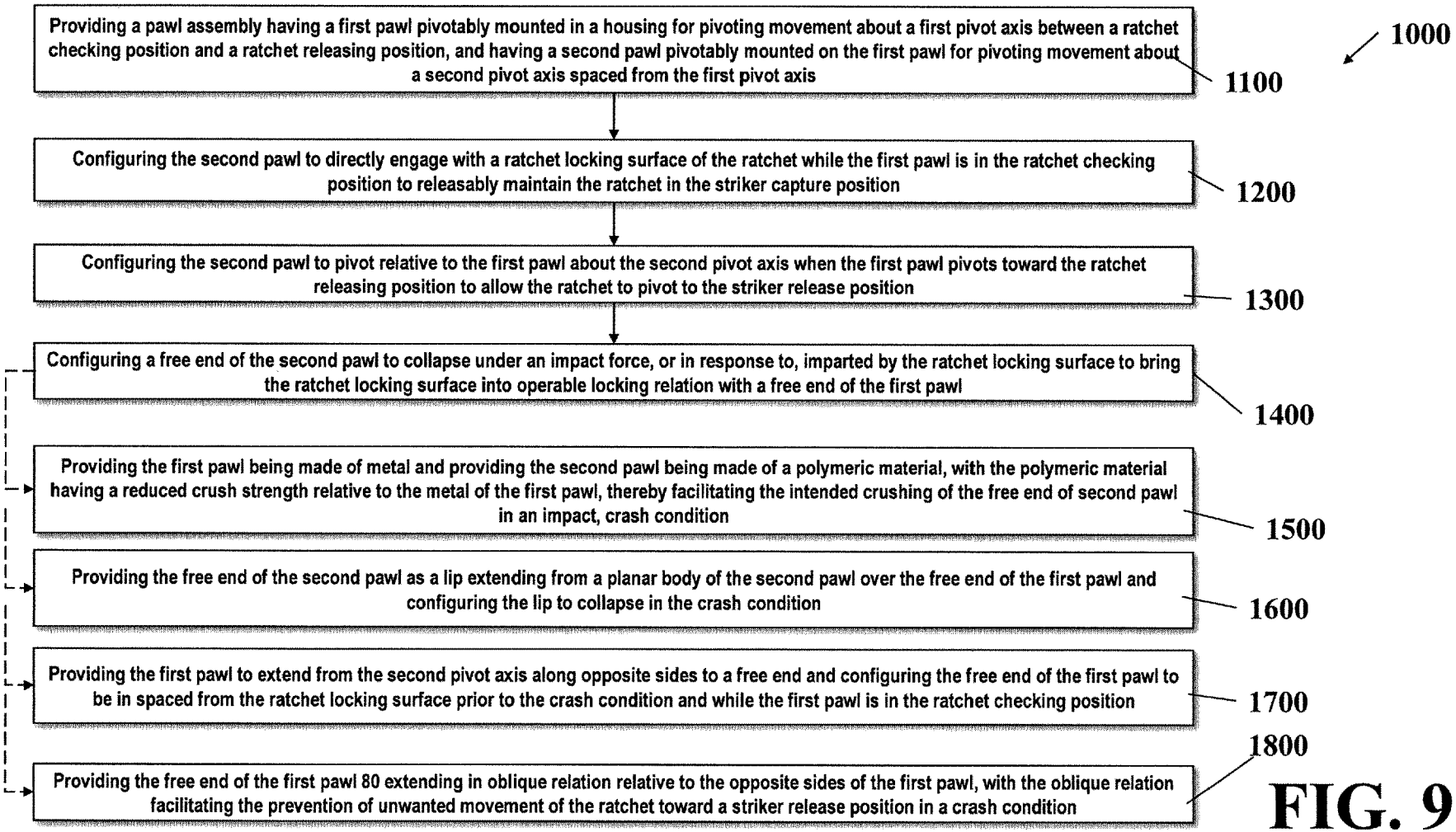
FIG. 9 is a flow diagram illustrating a method of preventing inadvertent release of a ratchet of a closure latch assembly from a striker capture position during a crash condition in accordance with another aspect of the disclosure.

In accordance with a further aspect, as shown in FIG. 9, a method 1000 of preventing inadvertent release of a ratchet 44 of a closure latch assembly 20 from a striker capture position during a crash condition is provided. The method, as shown in FIG. 9, includes a step 1100 of providing a pawl assembly 46 having a first pawl 80 pivotably mounted in a housing 42 for pivoting movement about a first pivot axis C1 between a ratchet checking position and a ratchet releasing position, and having a second pawl 82 pivotably mounted on the first pawl 80 for pivoting movement about a second pivot axis C2 spaced from the first pivot axis C1. Further, a step 1200 includes configuring the second pawl 82 to directly engage with a ratchet locking surface 68 of the ratchet 44 while the first pawl 80 is in the ratchet checking position to releasably maintain the ratchet 44 in the striker capture position, and further, a step 1300 includes configuring the second pawl 82 to pivot relative to the first pawl 80 about the second pivot axis C2 when the first pawl 80 pivots toward the ratchet releasing position to allow the ratchet 44 to pivot to the striker release position. Further yet, a step 1400 includes configuring a free end 94 of the second pawl 82 to collapse under an impact force, or in response to, imparted by the ratchet locking surface 68 to bring the ratchet locking surface 68 into operable locking relation with a free end 86 of the first pawl 80.

The method 1000 of preventing inadvertent release of a ratchet 44 of a closure latch assembly 20 from a striker capture position during a crash condition can further include a step 1500 of providing the first pawl 80 being made of metal and providing the second pawl 82 being made of a polymeric material, with the polymeric material having a reduced crush strength relative to the metal of the first pawl 80, thereby facilitating the intended crushing of the free end 94 of second pawl 82 in an impact, crash condition.

The method 1000 of preventing inadvertent release of a ratchet 44 of a closure latch assembly 20 from a striker capture position during a crash condition can further include a step 1600 of providing the free end 94 of the second pawl 82 as a lip 96 extending from a planar body of the second pawl 82 over the free end 86 of the first pawl 80 and configuring the lip 96 to collapse in the crash condition.

The method 1000 of preventing inadvertent release of a ratchet 44 of a closure latch assembly 20 from a striker capture position during a crash condition can further include a step 1700 of providing the first pawl 80 to extend from the second pivot axis C2 along opposite sides 84, 85 to a free end 86 and configuring the free end 86 of the first pawl 80 to be in spaced from the ratchet locking surface 68 prior to the crash condition and while the first pawl 80 is in the ratchet checking position.

The method 1000 of preventing inadvertent release of a ratchet 44 of a closure latch assembly 20 from a striker capture position during a crash condition can further include a step 1800 of providing the free end 86 of the first pawl 80 extending in oblique relation relative to the opposite sides 84, 85 of the first pawl 80, with the oblique relation facilitating the prevention of unwanted movement of the ratchet 44 toward a striker release position in a crash condition.

Figure 10:
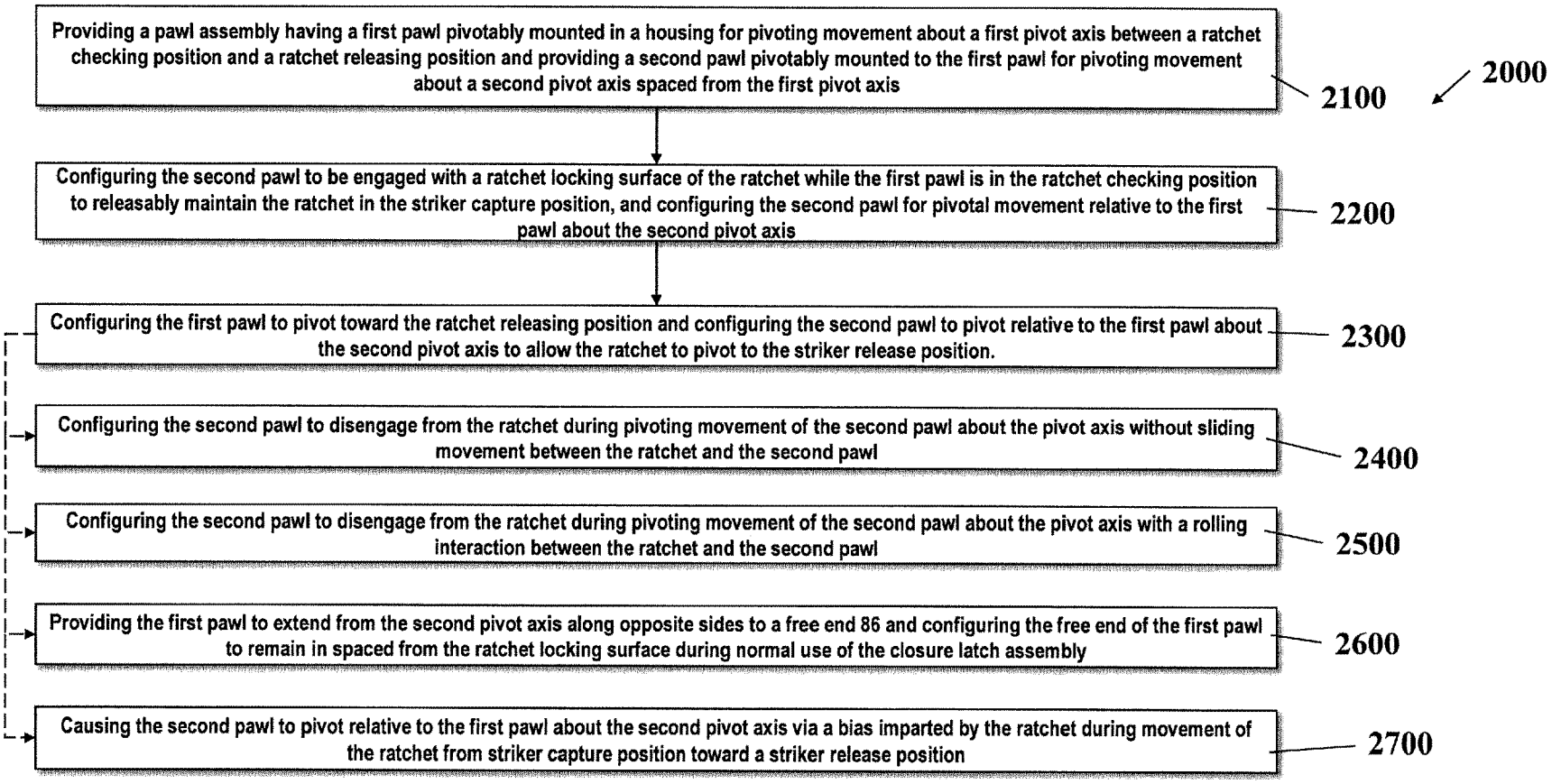
FIG. 10 is a flow diagram illustrating a method of causing a ratchet of a closure latch assembly to release from a striker capture position in accordance with another aspect of the disclosure.

In accordance with a further aspect, as shown in FIG. 10, a method 2000 of causing a ratchet 44 of a closure latch assembly 20 to release from a striker capture position is provided. The method 2000 includes, a step 2100 of providing a pawl assembly 46 having a first pawl 80 pivotably mounted in a housing 42 for pivoting movement about a first pivot axis C1 between a ratchet checking position and a ratchet releasing position and providing a second pawl 82 pivotably mounted to the first pawl 80 for pivoting movement about a second pivot axis C2 spaced from the first pivot axis C1. Further, a step 2200 includes configuring the second pawl 82 to be engaged with a ratchet locking surface 68 of the ratchet 44 while the first pawl 80 is in the ratchet checking position to releasably maintain the ratchet 44 in the striker capture position, and configuring the second pawl 82 for pivotal movement relative to the first pawl 80 about the second pivot axis C2. Further yet, a step 2300 includes configuring the first pawl 80 to pivot toward the ratchet releasing position and configuring the second pawl 82 to pivot relative to the first pawl 80 about the second pivot axis C2 to allow the ratchet 44 to pivot to the striker release position.

The method 2000 of causing a ratchet 44 of a closure latch assembly 20 to release from a striker capture position can further include a step 2400 of configuring the second pawl 82 to disengage from the ratchet 44 during pivoting movement of the second pawl 82 about the pivot axis C2 without sliding movement between the ratchet 44 and the second pawl 82.

The method 2000 of causing a ratchet 44 of a closure latch assembly 20 to release from a striker capture position can further include a step 2500 of configuring the second pawl 82 to disengage from the ratchet 44 during pivoting movement of the second pawl 82 about the pivot axis C2 with a rolling interaction between the ratchet 44 and the second pawl 82.

The method 2000 of causing a ratchet 44 of a closure latch assembly 20 to release from a striker capture position can further include a step 2600 of providing the first pawl 80 to extend from the second pivot axis C2 along opposite sides 84, 85 to a free end 86 and configuring the free end 86 of the first pawl 80 to remain in spaced from the ratchet locking surface 68 during normal use of the closure latch assembly 20.

The method 2000 of causing a ratchet 44 of a closure latch assembly 20 to release from a striker capture position can further include a step 2700 of causing the second pawl 82 to pivot relative to the first pawl 80 about the second pivot axis C2 via a bias imparted by the ratchet 44 during movement of the ratchet 44 from striker capture position toward a striker release position.

Figure 12:
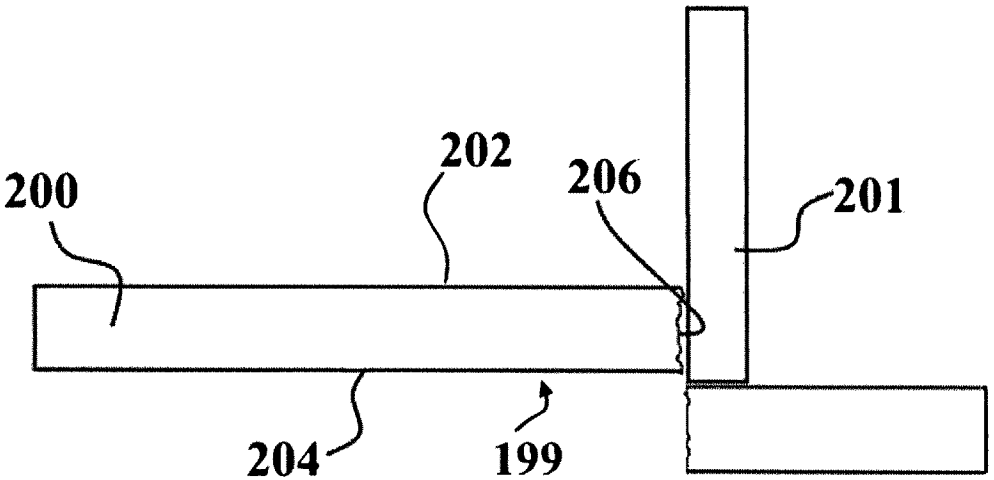
FIGS. 11 to 14 are a series of views illustrating steps for forming a pawl assembly, in accordance with an illustrative embodiment of the present disclosure.
Figure 11:
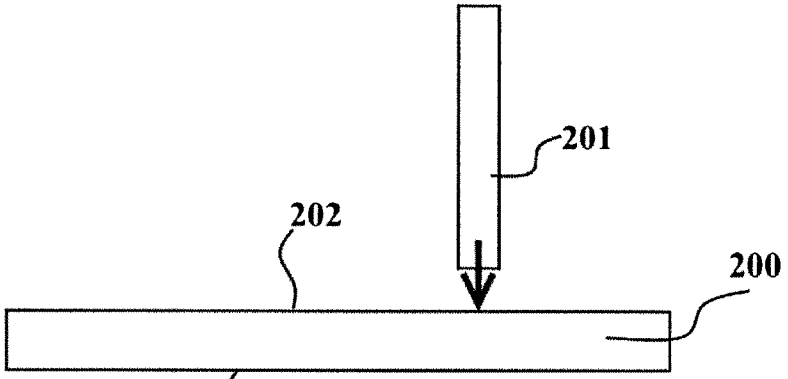
Figure 14:
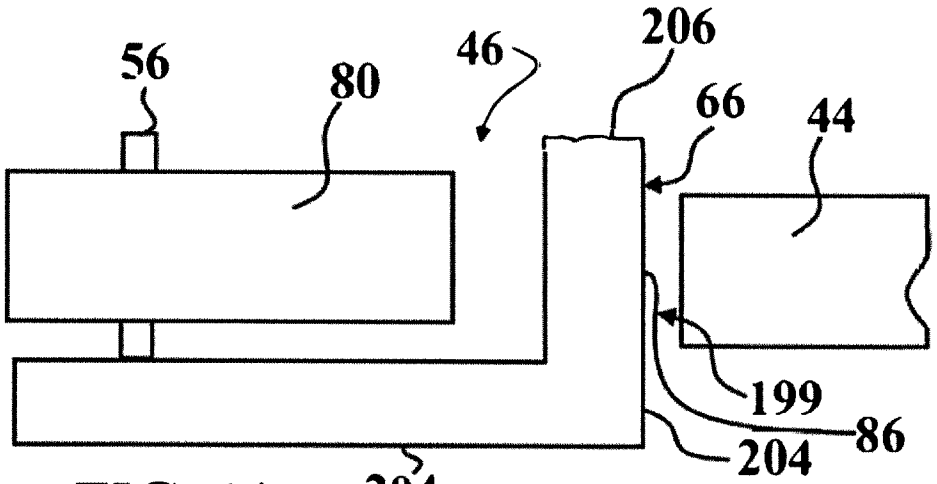
Figure 13:
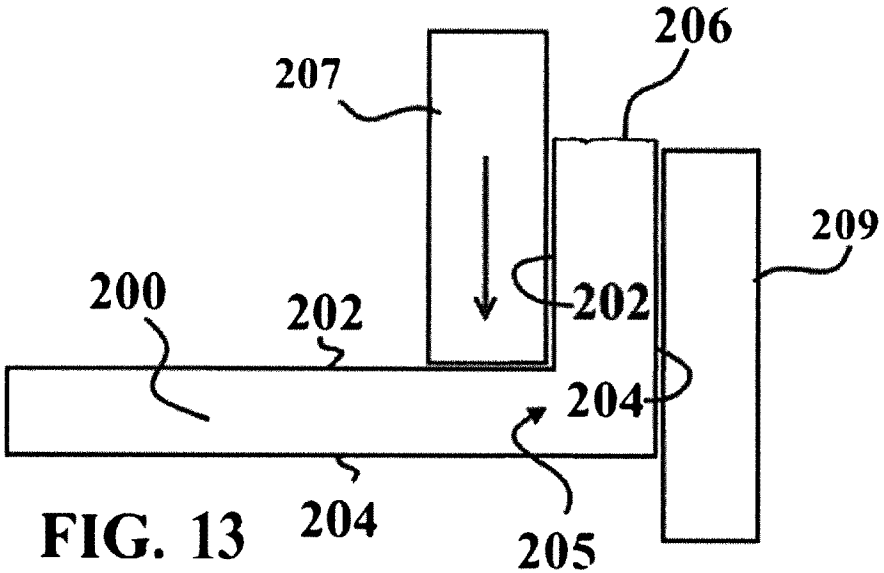

Now referring to FIGS. 12 to 15, in addition to FIGS. 4A to 8B, there is illustrated a pawl assembly 46 for a closure latch assembly 20 for a motor vehicle closure panel, the pawl assembly 46 being formed from a processed piece of metal sheeting 200, such as formed by stamping a metal blank, such that a free end, such as free end 94, engageable with the ratchet 44, and in particular the surface forming the free end 94 facing the ratchet 44, is defined by an uncut portion 199 of the metal sheet 200. The metal sheet 200 includes opposite sides 202, 204 extending between a cut portion 206 of the metal sheet 200 and the uncut portion 199 forming the free end 94 and for example is defined by one of the opposite sides 202, 204. During a stamping process which may include a cutting or shearing of the metal sheet 200 using a punch 201 as schematically illustrated in FIG. 11 for simplicity, so as to form the desired shape and dimension of the pawl assembly and for example of the second pawl 82, the formation of burrs, shearing and/or die roll, or like imperfections 203 may result on the exposed surface of cut portion 206 as shown in FIG. 12, such imperfections greater than those formed as compared to the unprocessed surface of the opposite side 202, 204 which may be unscathed during stamping. Such imperfections may create undesirable increases in friction to the cut portion 206 should it be used to engage the pawl assembly 46 with the ratchet 44 for example during a sliding and/or rolling engagement of the free end 94 with the ratchet 44, as is done in the art. As a consequence of such undesired increases to friction, release efforts of the pawl assembly 46 from the ratchet 44 due to the increased frictional interaction between the cut portion 206 and the ratchet 44 may occur. The cut portion 206 may have a coefficient of friction that is greater than a coefficient of friction of the uncut portion 199 formed by one of the opposite sides 202, 204. The present disclosure provides for using an uncut portion 199 of the metal sheet 200, and for example employing one of the opposite side 202, 204 unscathed during a stamping process for forming the pawl assembly 46 to provide a low friction engaging surface of the pawl assembly 46 with the ratchet 44 for further reducing release efforts which may occur for example during a sliding and/or rolling and/or pivoting of the pawl assembly 46 on to the ratchet 44 e.g. on the surface 68. According to the illustrative example referred to herein, the second pawl 82 of a double-pawl configuration for a latch assembly 20 illustrated herein is manufactured and provided in such as manner, however a single pawl configuration for a latch assembly 20 may also be provided for using the teachings herein. The metal sheet 200 may be formed, for example as part of the stamping process, to include a bend 205 when the metal sheet 200 engages a punch 207 and die 209 as shown in schematically for simplicity in FIG. 13 to present one of the opposite sides 202, 204 to face a ratchet locking surface, such as the surface 68, when the metal sheet 200 is formed into the pawl assembly 46, and illustratively formed as the second pawl 82 as described hereinabove and as shown in FIG. 14, and when the pawl assembly 46 is in the ratchet checking position and the ratchet 44 is in one of the first striker capture position and the second striker capture position. The opposite sides 202, 204 are formed by a rolling process and/or other metal forming process for forming the metal sheet 200 having a smooth, and low friction (minimal imperfections) opposite sides 202, 204. The bend 205 may be formed by a stamping process applied to the metal sheet 200, which may be part of multiple step process such as a progressive stamping process including a cutting or shearing of the metal sheet 200 to form the cut portion 206 and bending process, as an example. Other steps may be provided for forming the pawl assembly, and for example the second pawl 82.

Figure 15:
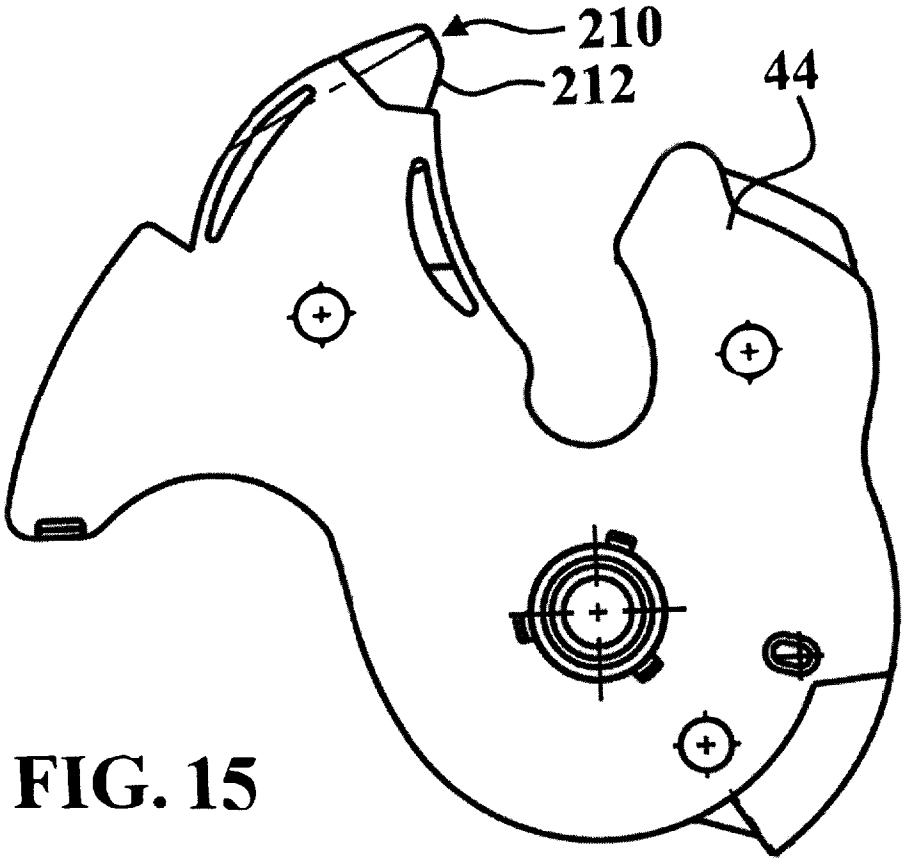
FIG. 15 is a close up view of a primary latch notch of the ratchet of FIGS. 4 to 8 in accordance with an illustrative embodiment.

Now referring to FIG. 15, there is illustrated a configuration of the primary latch notch 68 of the ratchet 44 including an apex 210 for engaging the uncut portion 199 (e.g. free end 94), as shown for example in FIGS. 4A to 6B. The apex 210 presents to the uncut portion 199 a point contact for minimizing the surface area in engagement with the uncut portion 199 should a sliding action between the uncut portion 199 and the ratchet 44 result during a releasing operation. Furthermore during the releasing operation and in particular the pivoting of the second pawl 82, apex 210 provides a pivoting point upon which second pawl 82 may pivot into its ratchet releasing position reducing the amount of rolling interaction (e.g. provide a rapid rolling angle) and facilitating a rapid change in the angle of attack of the ratchet 44 upon the pawl assembly 46 minimizing the degree of sliding interaction between the ratchet 44 and the pawl assembly 46. Furthermore, the primary latch notch 68 of the ratchet 44 may further include a slope surface 212 extending from apex 210 for engaging the pawl assembly 44 upon a deformation of the deformable portion 100 during a crash event which may cause the alteration of the surface 86 of the free end 86 facing the ratchet 44 which may partially alter in shape (FIG. 4K) or adopt a different angle (see FIG. 4F) to present to the ratchet 44 an angled surface as described in more details above. Apex 210 may assist in the deformation of the deformable portion for example when apex 210 directly engages with deformable portion e.g. lip 96 as shown in FIG. 4K. Sloped surface 212 therefore provides a wider surface area through which force 109 can be applied to pawl assembly 44 for ensuring force vector 109 is appropriately directed to ensure a closing torque on pawl assembly 44 during a crash condition. In an example sloped surface 212 may be aligned with oblique abutment surface 69 e.g. aligned in parallel relationship when the ratchet is in the second striker capture position and the deformable portion 100 has been deformed as a result of a crash event or accident. As another example, sloped surface 212 provides an increased surface area to engage pawl assembly 44 for increasing the friction forces between the two components during a crash event to assist with retaining the pawl assembly 46 in its ratchet holding or checking position.

The foregoing description of the embodiment(s) has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Those skilled in the art will recognize that concepts disclosed in association with the example detection system can likewise be implemented into many other systems to control one or more operations and/or functions.

What is claimed is:

1. A closure latch assembly for a motor vehicle closure panel, comprising:

a housing;

a ratchet pivotably mounted in said housing for pivoting movement between a first striker capture position, a second striker capture position and a striker release position, said ratchet having a ratchet locking surface; and a pawl assembly pivotally mounted in said housing for pivoting movement about a pivot axis between a ratchet checking position and ratchet releasing position and comprising a free end being engaged with said ratchet locking surface while said pawl assembly is in said ratchet checking position to releasably maintain said ratchet in one of said first striker capture position and said second striker capture position and a deformable portion undergoing a deformation allowing said ratchet to pivot from said first striker capture position to said second striker capture position in response to said ratchet pivoting during a crash event;

wherein said pawl assembly comprises a first pawl and a second pawl operably coupled to one another, said second pawl comprising said free end and said deformable portion, wherein said free end is positioned between the ratchet locking surface and an abutment surface of said first pawl;

wherein said second pawl is configured to abut said abutment surface of said first pawl in response to said deformation to limit travel of said free end towards said pivot axis during the crash event and to limit pivoting movement of the ratchet away from the second striker capture position towards the striker release position.

2. The closure latch assembly of claim 1, wherein said deformation alters an angle of a force applied by the ratchet on the pawl assembly to prevent the pawl assembly from moving to the ratchet releasing position.

3. The closure latch assembly of claim 2, wherein said deformation causes an increase in a closing torque on the pawl assembly due to the force applied by the ratchet to urge the pawl assembly towards the ratchet checking position when the ratchet is in the second striker capture position.

4. The closure latch assembly of claim 1, wherein said deformable portion extends along a longitudinal axis between the pivot axis and the free end.

5. The closure latch assembly of claim 4, wherein said deformable portion is configured to collapse towards the pivot axis during the crash event in response to the ratchet applying a force on the pawl assembly exceeding a critical load of the deformable portion.

6. The closure latch assembly of claim 5, wherein the deformable portion is formed from a metal sheet and said deformation is an out-of-plane buckling deformation of the metal sheet.

7. The closure latch assembly of claim 1, wherein said deformable portion extends parallel to the pivot axis.

8. The closure latch assembly of claim 1, wherein said second pawl is configured to abut an oblique surface provided on said first pawl when the ratchet is in the second striker capture position in response to said deformation to direct a force applied by the ratchet on the pawl assembly to increase a closing torque on the pawl assembly due to the force applied by the ratchet and urge the pawl assembly towards the ratchet checking position.

9. The closure latch assembly of claim 1, wherein said deformation alters a surface of the free end facing the ratchet to present to the ratchet an acutely angled surface relative to a line extending from a contact point of the ratchet on the surface through the pivot axis.

10. The closure latch assembly of claim 1, wherein the ratchet includes an apex for engaging said the pawl assembly when in the first striker capture position, and a sloped surface for engaging said pawl assembly when in the second striker capture position.

11. The closure latch assembly of claim 1, wherein said deformation shifts a force vector extending through the pivot axis as a result of the ratchet engaging the pawl assembly when the ratchet is in the first striker capture position and the pawl assembly is in the ratchet checking position to a force vector extending offset the pivot axis as a result of the ratchet engaging the pawl assembly when the ratchet is in the second striker capture position and the pawl is in the ratchet checking position.

12. The closure latch assembly of claim 1, wherein said second pawl is formed from a metal sheet, wherein said free end is defined by an uncut portion of the metal sheet extending between the ratchet locking surface and an abutment surface of the pawl assembly.

13. The closure latch assembly for a motor vehicle closure panel of claim 12, wherein said metal sheet comprises opposite sides extending between a cut portion of the metal sheet and said uncut portion is defined by one of the opposite sides.

14. The closure latch assembly for a motor vehicle closure panel of claim 13, where the cut portion comprises a coefficient of friction that is greater than a coefficient of friction of the uncut portion.

15. The closure latch assembly for a motor vehicle closure panel of claim 13, wherein said metal sheet comprises a bend to present one of the opposite sides to face the ratchet locking surface when the pawl assembly is in the ratchet checking position and the ratchet is the striker capture position.

16. The closure latch assembly for a motor vehicle closure panel of claim 15, wherein the ratchet includes an apex for engaging said uncut portion.

17. The closure latch assembly of claim 1, wherein the free end comprises an inner surface configured to face the abutment surface.

18. The closure latch assembly of claim 17, wherein the inner surface of the free end and the abutment surface are separated by a gap when the latch is in a non-crash event.

19. The closure latch assembly of claim 18, wherein the gap is defined between the free end and the abutment surface of the pawl assembly while said pawl assembly is in said ratchet checking position and the latch is in a non-crash event.

20. The closure panel of claim 1, wherein said deformation causes a gap defined between said free end and an abutment surface of the first pawl to close during a crash event to bring the free end and said abutment surface into abutting contact.

21. The closure panel of claim 20, wherein the gap is defined between the free end and the abutment surface while said pawl assembly is in said ratchet checking position and the latch is in a non-crash event.

22. A method of preventing inadvertent release of a ratchet of a closure latch assembly from a striker capture position to a striker release position during a crash condition, comprising:

providing a pawl assembly having a first pawl pivotably mounted in a housing for pivoting movement about a first pivot axis between a ratchet checking position and a ratchet releasing position and having a second pawl pivotably mounted on said first pawl for pivoting movement about a second pivot axis spaced from said first pivot axis, said second pawl having a surface being directly engaged with a ratchet locking surface of said ratchet and having an inner surface separated from an abutment surface of said first pawl by a gap while said first pawl is in said ratchet checking position to releasably maintain said ratchet in said striker capture position and said second pawl being pivotal relative to said first pawl about said second pivot axis when said first pawl pivots toward said ratchet releasing position to allow said ratchet to pivot to the striker release position; and configuring the second pawl to collapse under an impact force imparted by said ratchet locking surface to bring the inner surface of said second pawl into operable locking relation with the abutment surface of said first pawl.

23. A closure latch assembly for a motor vehicle closure panel, comprising:

a housing;

a ratchet pivotably mounted in said housing for pivoting movement between a first striker capture position, a second striker capture position and a striker release position, said ratchet having a ratchet locking surface; and a pawl assembly pivotally mounted in said housing for pivoting movement about a pivot axis between a ratchet checking position and ratchet releasing position and comprising a free end being engaged with said ratchet locking surface while said pawl assembly is in said ratchet checking position to releasably maintain said ratchet in one of said first striker capture position and said second striker capture position and a deformable portion undergoing a deformation allowing said ratchet to pivot from said first striker capture position to said second striker capture position in response to said ratchet pivoting during a crash event;

wherein said pawl assembly comprises a first pawl and a second pawl operably coupled to one another, said second pawl comprising said free end and said deformable portion, wherein said free end is positioned between the ratchet locking surface and an abutment surface of said first pawl;

wherein the free end comprises an inner surface configured to face the abutment surface;

wherein the inner surface of the free end and the abutment surface are separated by a gap when the latch is in a non-crash event;

wherein the gap is defined between the free end and the abutment surface of the pawl assembly while said pawl assembly is in said ratchet checking position and the latch is in a non-crash event;

wherein said deformation causes the gap to close during a crash event to bring the free end and said abutment surface into abutting contact.

24. The closure latch assembly of claim 23, wherein said second pawl is configured to abut said abutment surface of said first pawl in response to said deformation to limit travel of said free end towards said pivot axis during the crash event and to limit pivoting movement of the ratchet away from the second striker capture position towards the striker release position.

* * * * *